US005704415A

United States Patent [19]

Suzuki et al.

[11] Patent Number: 5,704,415

[45] Date of Patent: Jan. 6, 1998

[54] WINDING SMALL TUBE APPARATUS AND MANUFACTURING METHOD THEREOF

[75] Inventors: Masamichi Suzuki; Keiichi Sugiyama; Mitsuyoshi Fujiike, all of Tokyo; Toshihiro Suzuki, Shizuoka-ken, all of Japan

[73] Assignees: Nippon Light Metal Co. Ltd., Tokyo; Actronics Company, Ltd., Osaka-fu; Soltech, Inc., all of, Japan

[21] Appl. No.: 561,701

[22] Filed: Nov. 22, 1995

[30] Foreign Application Priority Data

| | | | |
|---|---|---|---|
| Nov. 25, 1994 | [JP] | Japan | 6-315621 |
| Jan. 20, 1995 | [JP] | Japan | 7-026206 |
| Jan. 20, 1995 | [JP] | Japan | 7-026207 |

[51] Int. Cl.[6] ..... F28D 15/02

[52] U.S. Cl. ..... 165/104.26; 165/104.21; 165/168; 29/890.032

[58] Field of Search ..... 165/168, 170, 165/177, 183, 104.26, 104.21; 29/890.032

[56] References Cited

U.S. PATENT DOCUMENTS

| | | | |
|---|---|---|---|
| 897,792 | 9/1908 | Silvey | 165/168 X |
| 2,572,972 | 10/1951 | Baldwin | 165/168 |
| 4,156,419 | 5/1979 | Lewis, Sr. | 165/170 X |
| 4,353,416 | 10/1982 | Buschfeld | 165/168 |
| 4,579,605 | 4/1986 | Kawase et al. | 148/26 |
| 4,830,100 | 5/1989 | Kato et al. | 29/890.032 X |
| 4,921,041 | 5/1990 | Akachi | 165/104.26 X |
| 5,029,389 | 7/1991 | Tanzer | 29/890.032 |
| 5,197,539 | 3/1993 | Hughes et al. | 165/172 |
| 5,219,020 | 6/1993 | Akachi | 165/104.26 |

FOREIGN PATENT DOCUMENTS

| | | | |
|---|---|---|---|
| 261584 | 2/1963 | Australia | 165/168 |
| 557994 | 1/1975 | Switzerland | 165/168 |
| 886194 | 1/1962 | United Kingdom | 165/170 |

OTHER PUBLICATIONS

Nikkei Mechanical, 1994.5.30, pp. 8–9.

Japan Society of Mechanical Engineering, 71st JSME Spring Annual Meeting, lecture papers vol. 3, held Mar. 29–31, 1994, pp. 606–611.

*Primary Examiner*—Leonard R. Leo

*Attorney, Agent, or Firm*—Heslin & Rothenberg, P.C.

[57] ABSTRACT

The winding small tube apparatus comprises an extruded flat tubed strip having a plurality of openings leading to parallel lumens and a header for attaching to an end of this extruded flat tubed strip to cover the openings. Every other portion of the partition at the openings of the lumens disposed in the extruded flat tubed strip is cut away to connect the lumens to form a continuous winding, serpentine sealed channel. By this invention, the manufacturing process is facilitated, the overall height of the apparatus is lowered, and the heat exchange property is raised.

41 Claims, 17 Drawing Sheets

WINDING SMALL TUBE APPARATUS AND MANUFACTURING METHOD THEREOF

FIELD OF THE INVENTION

This invention relates to a small winding tube apparatus, and more specifically, to a small winding tube apparatus that is used as a heat pipe and to a manufacturing method thereof.

BACKGROUND OF THE INVENTION

In general, as a cooling means for semiconductors and such, which generate a significant amount of heat, a heat pipe, or more generally, a small winding tube body having a cooling medium sealed inside the winding tube is used. Prior art examples of this small winding tube body are (1) JPA 4-190090, which describes a small winding round tube, formed by extruding or drawing and then bending the tube in a winding fashion and (2) Nikkei Mechanical Magazine, Vol. 5, No. 30, pp. 8–9, (1994), which describes a winding passage formed by first cutting a small continuous, winding groove on a thin plate and then brazing a different plate on the thin plate.

The small winding tube body formed in the above manner is used as a small heat pipe of a loop type, and compared to a straight pipe, it has a much greater heat radiating property.

However, the former small winding tube body of type (1) above, where the small tube is bent in a winding fashion, suffers from problems such as high manufacturing costs, attributed to costly plastic deformation processings, and dimensional changes because of a spring back phenomenon, which leads to a loss in dimensional precision. Also, bending the small tube invites the possibility of blocking the channel of the tube altogether in some parts. Furthermore, as the height of the tube is lowered, there is a problem of incurring damages at the bending positions.

With regard to the small winding tube body of type (2) above, it would be possible to lower the height, but because the tube body requires a precision cutting process, manufacturing costs are high, and furthermore, the tube passage may become blocked by having brazing material spill into the passage of the tube, contributing to degrading the heat transfer rate.

Further, a pipe for introducing a cooling medium is welded on to the tube body and removed after the cooling medium is introduced. Then, the opening left by the removal of the pipe is closed by welding. This type of process is not only time consuming but also contributes to raising the manufacturing costs.

Additionally, these small winding tube bodies of the above have not been ideally designed for placement on or adjacent to the semiconductor devices because of the obstructive elements of the tube bodies, such as a terminal protruding end piece that prevent sufficiently good contact with the print substrate board for efficient heat transfer.

If a small winding tube body is to be attached to the print substrate board, a supporting material must be placed between the back surface of the small winding tube body and the print substrate board. However, in this instance, not only the attachment is time consuming but also the increased thickness contributes to inefficient usage of space. Furthermore, the supporting material between the print substrate board and the small winding tube body degrades the heat transfer rate.

SUMMARY OF THE INVENTION

The present invention is provided with the above problems in mind. The object of the present invention is to facilitate the manufacturing method so as to reduce the structural parts and the overall height. The further objects of the invention are to assure good connections between the extruded flat tubed strip and the headers, to facilitate the attachment of the strip to the print substrate board while making the entire structure slim, to produce a small winding tube apparatus that has a very high heat exchange efficiency, and to present a manufacturing method of this apparatus.

To realize the above objects, the first invention of the winding small tube apparatus comprises an extruded flat tubed strip having a plurality of openings leading to parallel lumens; and a header for connecting to an end of the extruded flat tubed strip to cover the openings; wherein a pair of the lumens adjoining each other are connected alternately at the end and the opposite end by cutting out a portion of a partition that separates the openings of the lumens adjoining each other to form a continuous winding sealed channel.

Further, the second invention of the winding small tube apparatus comprises an extruded flat tubed strip having a plurality of openings leading to parallel lumens; and a header for connecting to an end of the extruded flat tubed strip to cover the openings; wherein every other partition and every other outer surface perimeter extending partition at the openings to be covered by the header are cut out to connect the lumens to form a continuous winding sealed channel.

Concerning the above winding small tube apparatus, a part or a whole of the partition at the openings of the extruded flat tubed strip may be cut out to form a winding channel, and the outer surface of the extruded flat tubed strip may be flat and have a plurality of protrusions.

Further, the header, for instance, may be provided as a block body for tightly sealing an end of the extruded flat tubed strip and may also be formed to have a "U" cross-section for clamping on to the flat portion of the extruded flat tubed strip in tightly sealing its end. Still further, the header may be formed as a cap body to cover the end outer portion of the extruded flat tubed strip in tightly sealing its end. Moreover, the header may have a sealing portion for sealing the end of the extruded flat tubed strip and a linking channel for linking the lumens at the both edges of the extruded flat tubed strip.

It would be possible to use the above apparatus by itself or as a multiple combination of itself. In the case a multiple combination is used, it would be desirable to have fins situated between the winding small tube apparatuses.

Further, the third invention of the winding tube small apparatus comprises an extruded flat tubed strip having a plurality of openings leading to parallel lumens; and a header for connecting to an end of the extruded flat tubed strip to cover the openings; wherein the header is formed as a cap body for covering an end perimeter portion of the extruded flat tubed strip and has protruding partitions at the inner bottom side of the cap body for connecting to every other partition of the lumens.

Further, the fourth invention of the winding small tube apparatus is characterized in that a sealing block is placed between the same side ends of a plurality of extruded flat tubed strips each having a plurality of openings leading to parallel lumens; a header as a cap body is formed to cover the outer end perimeter portion of the entire extruded flat tubed strip; and the cap body has at its inner bottom portion, protruding partitions that adjoin every other sealing block.

Concerning the above winding small tube apparatus, it would be desirable to have the aluminum alloy extruded material constitute the extruded flat tubed strip. Moreover, the connection of the extruded flat tubed strip to the header may be welded, brazed, or bonded together, but it would be more desirable to braze them together with an anti-corrosive flux. It would also be desirable to coat the anti-corrosive flux beforehand at least on the extruded flat tubed strip or the header.

The fifth invention of the winding small tube apparatus comprises an extruded flat tubed strip having a plurality of openings leading to parallel lumens; and a header for connecting to an end of the extruded flat tubed strip to cover the openings; wherein a linking portion for linking the lumens to form a winding channel is formed at least on the extruded flat tubed strip or the header; and one of the openings of the extruded flat tubed strip is made into a nozzle for introducing a cooling medium.

Concerning this invention, it would also be desirable to have an aluminum alloy extruded material constitute the extruded flat tubed strip. Moreover, the connection of the extruded flat tubed strip to the header may be welded, brazed, or bonded together, but it would be more desirable to braze them together with an anti-corrosive flux. It would also be desirable to coat the anti-corrosive flux beforehand at least on the extruded flat tubed strip or the header.

Also, the above-mentioned linking portions may be formed by cutting out the every other partition or the every other partition and the part of the partition that extends to the outer surface. The linking portions may also be formed by protrusions on the inner surface of the header that seals the extruded flat tubed strip, whereby each of this protrusions attaches to the every other partition of the lumens.

The sixth invention of the winding small tube apparatus comprises an extruded flat tubed strip having a plurality of openings leading to parallel lumens; and a header for connecting to an end of the extruded flat tubed strip to cover the openings; wherein a pair of the lumens adjoining each other are connected alternately at the end and the opposite end by cutting out a portion of a partition that separates the openings of the lumens adjoining each other; the header is inserted and connected to a cut-out level that leaves intact the outer wall of the extruded flat tubed strip; and the outer surface of the header is positioned inside the extruded flat tubed strip to form a continuous winding sealed channel.

The seventh invention of the winding small tube apparatus comprises an extruded flat tubed strip having a plurality of openings leading to parallel lumens; and a header for connecting to an end of the extruded flat tubed strip to cover the openings; wherein a pair of the lumens adjoining each other are connected alternately at the end and the opposite end by cutting out a portion of a partition that separates the openings of the lumens adjoining each other; the header is inserted and connected to a cut-out level that has the outer wall of the extruded flat tubed strip uncut, and the header is made of an outer header body, which is placed inside the extruded flat tubed strip, and an inside header body that is inserted and connected to an inner-cut-out level between the partitions at both sides of the extruded flat tubed strip; and the outer header body and the inner header body coordinate to form a linking channel that links the lumens at the both extreme sides of the extruded flat tubed strip.

Concerning this invention, it would be desirable to have an aluminum alloy extruded material constitute the extruded flat tubed strip. Moreover, the connection of the extruded flat tubed strip to the header may be welded, brazed, or bonded together, but it would be more desirable to braze them together with an anti-corrosive flux. It would also be desirable to coat the anti-corrosive flux beforehand at least on the extruded flat tubed strip or the header.

Concerning the winding small tube apparatus, since a part or a whole of the partition of the extruded flat tubed strip having a plurality of openings leading to parallel lumens is cut out, or the lumens are connected in a winding fashion by utilizing the protrusions placed on the header, a small winding channel is formed on the same plane surface, and there is no limit like that of bending a small pipe; and consequently, the radius of the winding curvature can be made very small. For instance, it would be possible to realize a radius of the winding curvature that is ½ the thickness of the partition of the lumens (such as 0.1 mm). Moreover, it would be possible to form an opening of the extruded flat tubed strip that has a diameter of less than 1 mm, or more precisely, 0.3 mm.

Further, this invention of the winding small tube apparatus has a highly efficient heat exchanging characteristic because it is formed by joining the extruded flat tubed strip and the header where they can be joined easily and with reduced brazing material, eliminating the danger of brazing material flowing into the channel and causing a blockage.

Further, by forming the header into a cap body that covers the outer end perimeter portion of the extruded flat tubed strip and, at the same time, by having protrusions on the inner bottom side of the cap body that join with every other partition of the lumens, the lumens are connected to form a winding channel without cutting away the partitions at the openings.

Further, by having sealing blocks placed between the extruded flat tubed strips at each end, by forming the header into a cap body that covers the outer end perimeter of a plurality of the extruded flat tubed strips, and by having protrusions on the inner bottom side of the cap body in which the protrusions join with every other sealing block, it becomes possible to connect the lumens to form a winding channel in a plurality of extruded flat tubed strips.

Further, by making one of the openings of the extruded flat tubed strip a nozzle for introducing a cooling medium, the need for attaching and detaching a separate pipe and such for introducing and sealing in the cooling medium is eliminated. Therefore, the manufacturing process is facilitated and a reduction in the number parts is accomplished.

Further, the winding small tube apparatus of the present invention is able to assure a tight connection between the extruded flat tubed strip and the header by the insertion of the header into the cut-out level portion, which has the outer wall of the extruded flat tubed strip uncut. Moreover, the apparatus is made very thin and a single planar attachment to a print substrate board is made by placing the header inside the extruded flat tubed strip.

Still further, according to the winding small tube apparatus of the present invention, the header is inserted and attached to the outer cut-out level portion, which has the outer wall on the terminal side of the extruded flat tubed strip uncut, and the header is made of the outer header body, which is contained within the extruded flat tubed strip, and the inner header body, which is inserted and attached to the inner cut-out level portion between the partitions at the edge sides of the extruded flat tubed strip. The outer header body and the inner header body coordinate to form a linking channel to link the lumens on the both extreme sides of the extruded flat tubed strip; the cooling medium sealed inside the channel is able to circulate from one extreme side of the apparatus back to the other extreme side via the linking channel in the header after the medium has flowed and transported heat through each of the lumens in a winding fashion from one side of the apparatus to the other. Therefore, the cooling medium is able to flow freely and the heat exchange efficiency is raised.

The manufacturing method of the winding small tube apparatus comprises the steps of cutting out one or more of the end of the opening portion of the extruded flat tubed strip, connecting the lumens in a winding fashion by connecting a header to an end where the cut-out portion and uncut portions are present, introducing the cooling medium through one of the openings, and closing the mouth of this opening.

While the specification concludes with claims particularly pointing out and distinctly claiming the subject matter which is regarded as the invention, it is believed that the invention, the objects and features and advantages thereof will be better understood from the following description taken in connection with the accompanying drawings.

DESCRIPTION OF THE PREFERRED EMBODIMENTS

The embodiments of the present invention are explained below in reference with the accompanying figures.

Figure 1A:
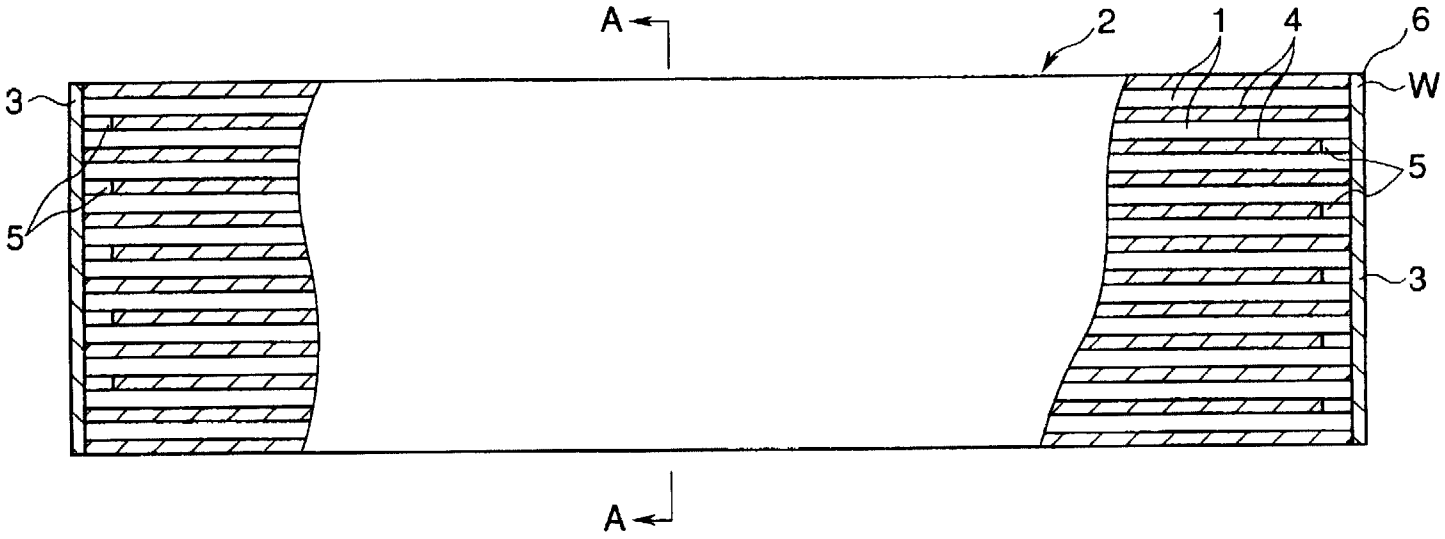
FIG. 1A shows a part of the first embodiment of the winding small tube apparatus of the present invention as a cross-sectional schematic drawing.
Figure 1B:
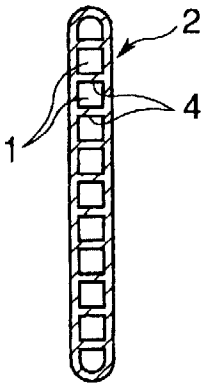
FIG. 1B shows an A—A cross sectional schematic drawing of a part of the first embodiment.

FIG. 1A shows a cross-sectional schematic drawing of a part of the first embodiment of a winding small tube apparatus of the present invention, and FIG. 1B shows an A—A cross-sectional view of this embodiment.

A winding small tube apparatus of the present invention comprises an extruded flat tubed strip 2 having a plurality of openings leading to parallel lumens 1 and a header 3 which attaches to an end of the extruded flat tubed strip 2, and a cooling medium is sealed inside the channel formed by connecting the lumens 1 of the extruded flat tubed strip 2.

Figure 2:
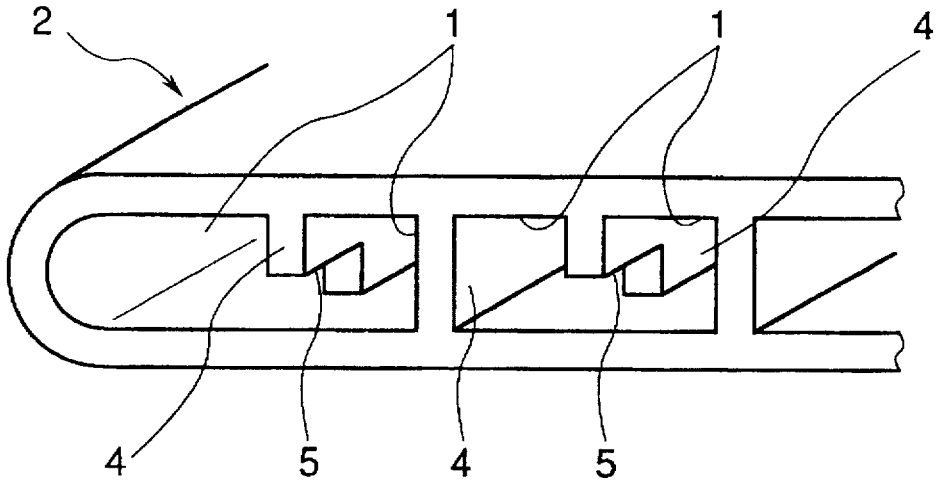
FIG. 2 shows a perspective view of an extruded flat tubed strip of the first embodiment.

In this instance, the extruded flat tubed strip 2 is made of an aluminum alloy extruded formed material. Furthermore, every other partition 4 near the openings at the terminal side of the header 3 is cut away (cut-out 5) to connect the lumens 1 in a winding, serpentine fashion (see FIG. 2).

Figure 3:
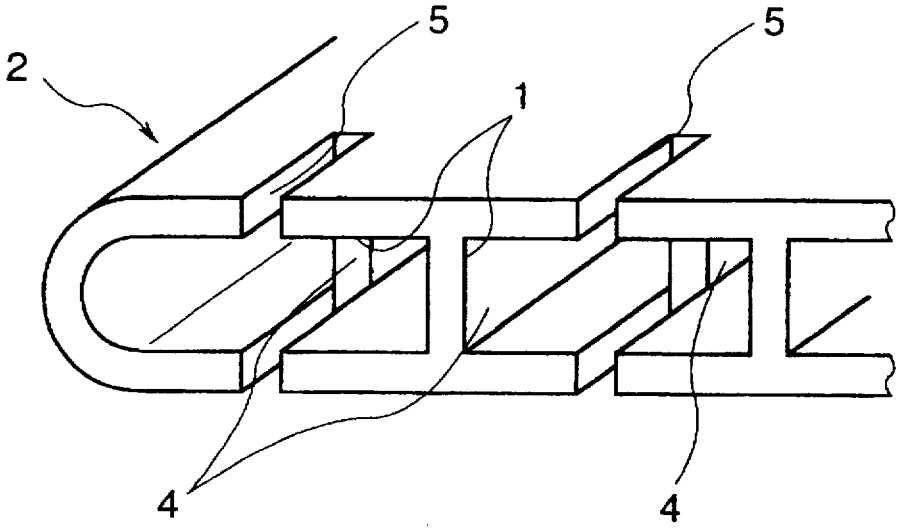
FIG. 3 shows a perspective view of another structure of an extruded flat tubed strip of the first embodiment.

It is not necessary to limit the cut-out 5 to just a part of the partition 4. As shown in FIG. 3, every other partition 4 and a perimeter extending partition of the partition 4, a portion that extends from the partition 4 to the outside surface, may be cut out to connect the lumens 1 to form a winding, serpentine channel.

Figure 4C:
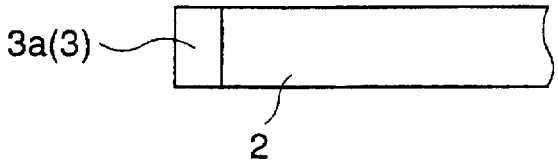
FIG. 4C is an example of a top surface view of a header connection of the present invention.
Figure 4B:
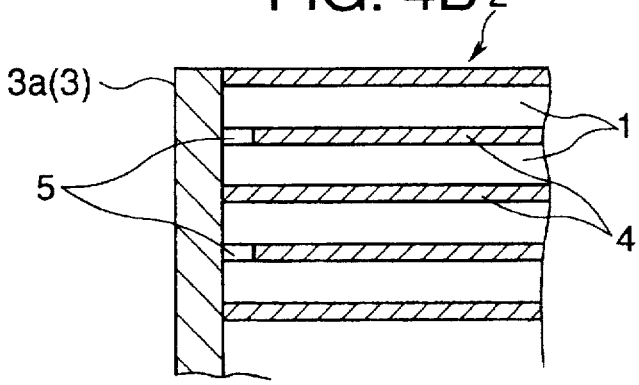
FIG. 4B is an example of a B—B cross-sectional view of a header connection of the present invention.
Figure 4A:
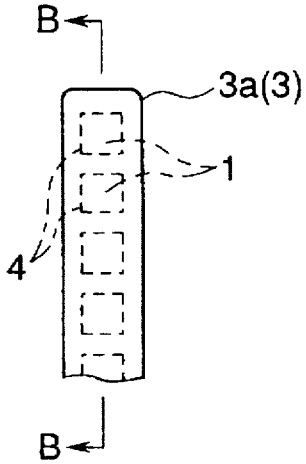
FIG. 4A is an example of a side surface view of a header connection of the present invention.

The header 3 is sealed tightly to the end of the extruded flat tubed strip 2 and is made of, for example, a block body 3*a* of aluminum alloy, as shown in FIGS. 4A to 4C. A part of the header 3 has a mouth 6 for introducing and sealing in a cooling medium, as shown in FIG. 1. After the cooling medium is sealed in the channel formed by the lumens 1, the mouth 6 is closed by welding (W).

As indicated above, the winding small tube apparatus of the present invention can be used as a heat pipe by cutting out the cut-outs 5 of the openings of the lumens 1 of the extruded flat tubed strip 2 to form a winding channel and sealing the cooling medium inside this channel.

Figure 5C:
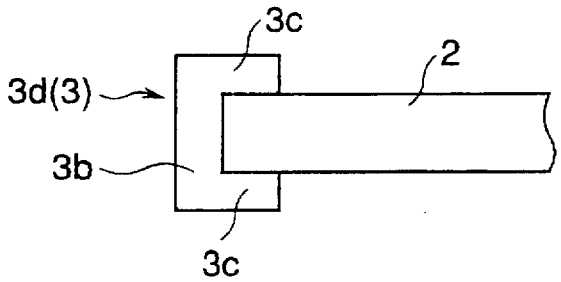
FIG. 5C is another example of a top surface view of a header connection of the present invention.
Figure 5B:
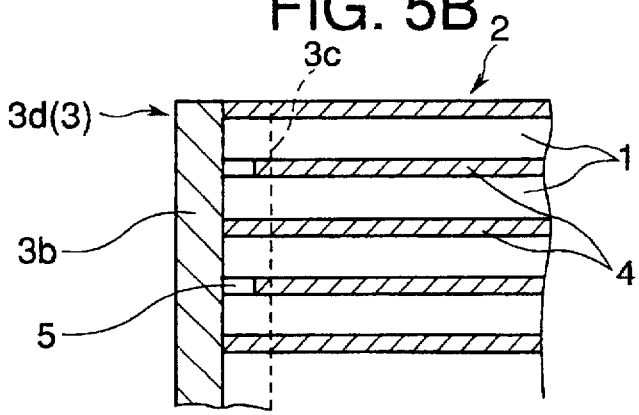
FIG. 5B is another example of a C—C cross-sectional view of a header connection of the present invention.
Figure 5A:
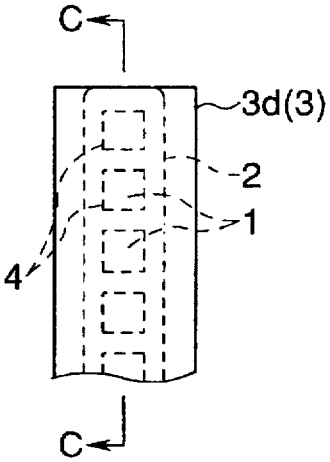
FIG. 5A is another example of a side surface view of a header connection of the present invention.
Figure 6C:
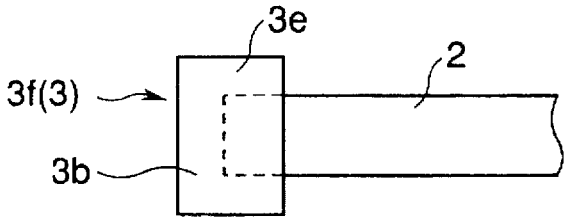
FIG. 6C is still another example of a top surface view of a header connection of the present invention.
Figure 6B:
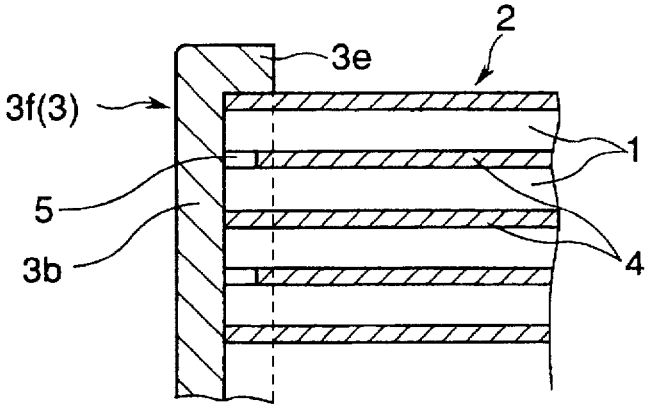
FIG. 6B is still another example of a D—D cross-sectional view of a header connection of the present invention.
Figure 6A:
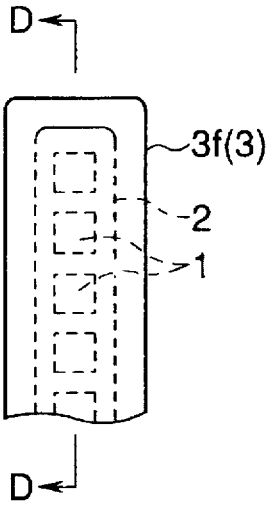
FIG. 6A is still another example of a side surface view of a header connection of the present invention.

In the above-mentioned embodiment, an explanation was made whereby the header 3 is made of the block body 3*a*, but in the case the partition 4 and the perimeter extending partition of the partition 4 at the openings are cut out as shown in FIG. 3, the header 3 is made to form a U-shaped cross-sectional body 3*d* (hereinafter called the U-shaped body), which comprises a header base section 3*b* that tightly seals the end surface of the extruded flat tubed strip 2 and flange sections 3*c* that bend from this header base section 3*b* on both sides and clamp on to the flat portion of the extruded flat tubed strip 2, as shown in FIGS. 5A to 5C. Alternatively, if the header 3 is made into a cap body 3*f* comprising, as shown in FIGS. 6A to 6C, a header base section 3*b* that seals the end of the extruded flat tubed strip 2 and an edge section 3*e* that encapsulates the end perimeter portion of the extruded flat tubed strip 2, the connection between the extruded flat tubed strip 2 and the header 3 can be further assured to form a tight seal.

The extruded flat tubed strip 2 formed in the above manner and the header 3 may be either welded, brazed, or bonded together, and, for instance, in brazing, it would be desirable to connect them by using an anti-corrosive flux of either $KF+AlF_3$, $KAlF_4$, $K_3AlF_6$, or $K_2AlF_5$. $H_2O$ or a combination thereof. In this instance, it would be desirable to coat the anti-corrosive flux at least on the extruded flat tubed strip 2 or the header 3 beforehand. If the material is aluminum, it would be desirable to coat Si and an anti-corrosive flux of, for example, a combination of $KAlF_4$,+ $K_3AlF_6$, on the metallic surface where the connection is going to be made.

Figure 7A:
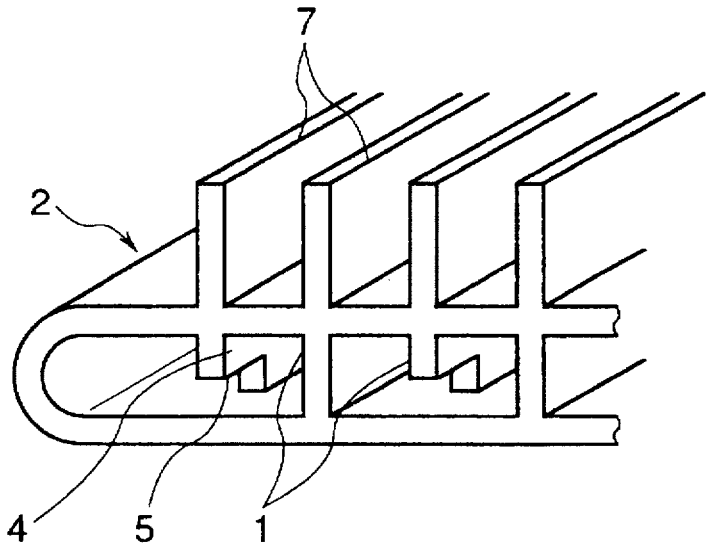
FIGS. 7A and 7B show further structures of an extruded flat tubed strip in accordance with the second embodiment of a winding small tube apparatus of the present invention.
Figure 7B:
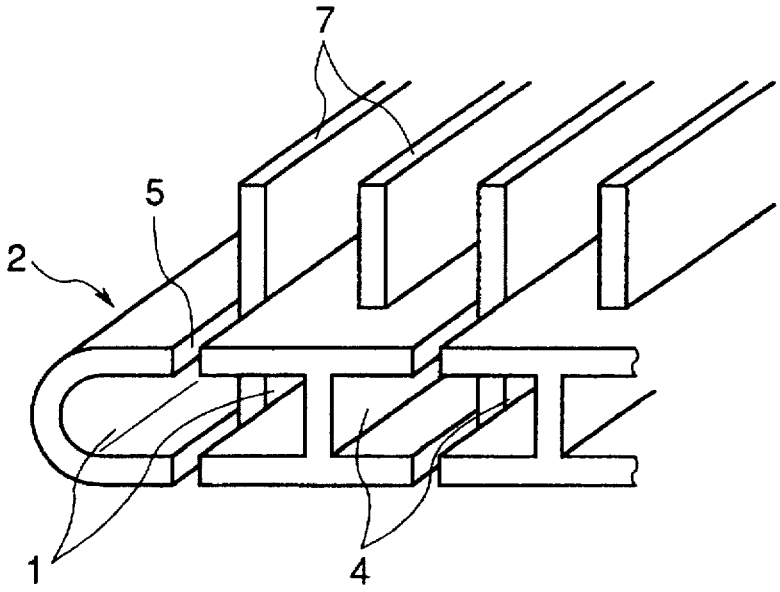

FIGS. 7A and 7B show perspective views of the second embodiment of a winding small tube apparatus of the present invention.

The second embodiment indicates a case in which the extruded flat tubed strip 2 is strengthened and is made to have an excellent heat exchanging characteristic. That is, it indicates a case in which a plurality of protrusions 7 are placed mutually parallel along the length of the extruded flat tubed strip 2 at the outer surface of the extruded flat tubed strip 2. In this instance, by having the protrusions 7 at the extended part of the partitions 4 of the lumens 1, the formation of the extruded flat tubed strip 2 is facilitated and the strength of the extruded flat tubed strip 2 is increased.

In this way, by having the protrusions 7 on the outer surface of the extruded flat tubed strip 2, heat dissipation is further promoted in conjunction with the heat transport by the cooling medium sealed inside the channel of the extruded flat tubed strip 2.

The other parts of the second embodiment are the same as in the first embodiment, and therefore, explanation on these will not be provided.

Figure 8A:
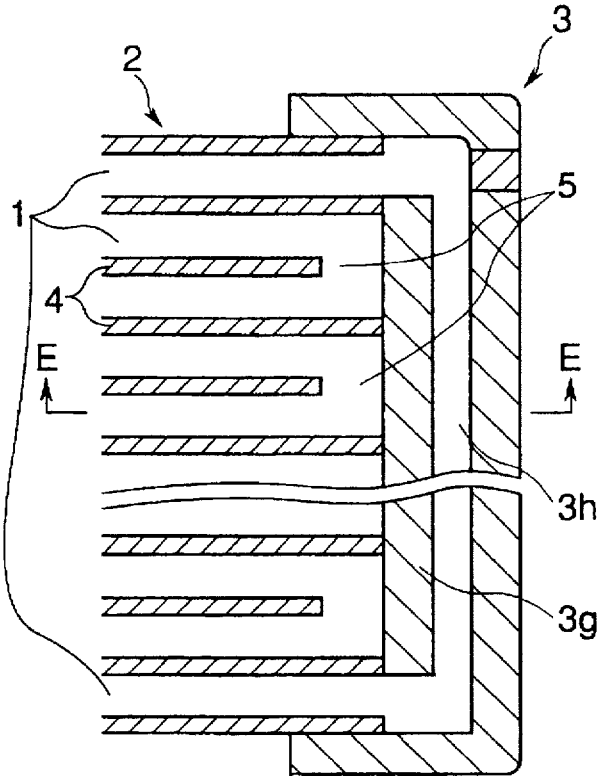
FIG. 8A is a cross-sectional view of a header connection of the third embodiment of a winding small tube apparatus of the present invention.
Figure 8B:
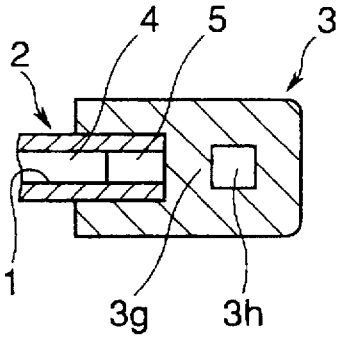
FIG. 8B is an E—E cross-sectional view of a header connection of the third embodiment of a winding small tube apparatus of the present invention.

FIGS. 8A and 8B show a cross-sectional view and an E—E cross-sectional view, respectively, of the third embodiment of a winding small tube apparatus of the present invention.

The third embodiment shows a case in which the winding channel are linked without an end and the heat of the cooling medium is made to be transported smoothly. That is, it shows a case in which the header 3 is provided with a sealing section 3*g* for sealing the end of the extruded flat tubed strip 2 and with a linking channel 3*h* for linking the lumens 1 at the extreme sides of the extruded flat tubed strip 2 to link the channel formed by the lumens 1 into a loop. By linking the channel into a loop, after heat is transported by the cooling medium in a winding fashion through the channel from one side of the apparatus, where the cooling medium is introduced and sealed, the cooling medium is circulated back to this same side through the linking channel 3*h* in the header. Because of this, there is no interruption in the flow of the cooling medium and the heat exchange efficiency in connection with heat transport by the cooling medium is promoted.

The other parts of the third embodiment are as same as those in the first embodiment, where the like parts are designated by like numerals and symbols, and therefore, no further comments on these will be provided.

Figure 9:
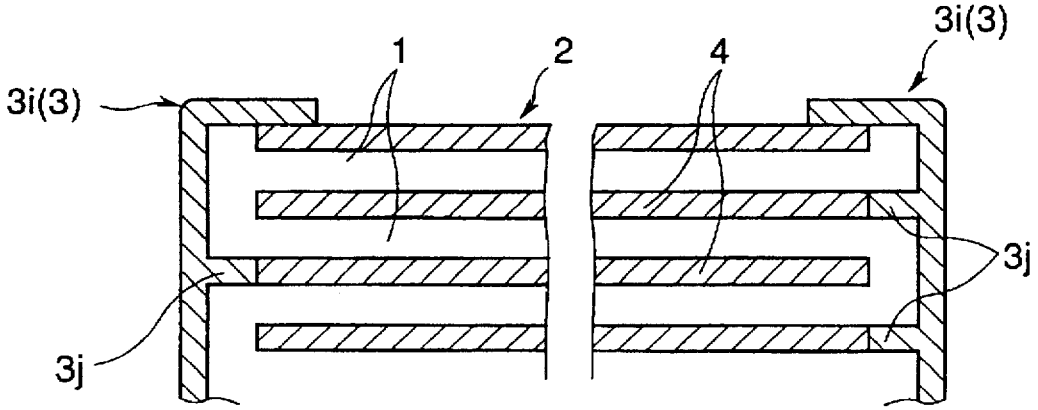
FIG. 9 is a cross-sectional view of the fourth embodiment of a winding small tube apparatus of the present invention.

FIG. 9 shows a cross-sectional view of the fourth embodiment of a winding small tube apparatus of the present invention.

The fourth embodiment shows a case in which the lumens 1 are linked in a winding fashion without the cut-out 5 on the partitions 4 at the openings of the extruded flat tubed strip 2. That is, it shows a case in which the header 3 is formed into a cap body 3*i* for encapsulating the outer end perimeter portion of the extruded flat tubed strip 2 and wall protrusions 3*j* that connect with every other partition 4 at the openings. By structuring in this manner, there is no need to cut away the partitions 4 at the openings, and consequently, the work process is reduced, and the winding small tube apparatus can be manufactured simply and at low cost.

The other parts of the fourth embodiment are as same as those in the first embodiment, and therefore, no further explanation on these will be provided.

Figure 10A:
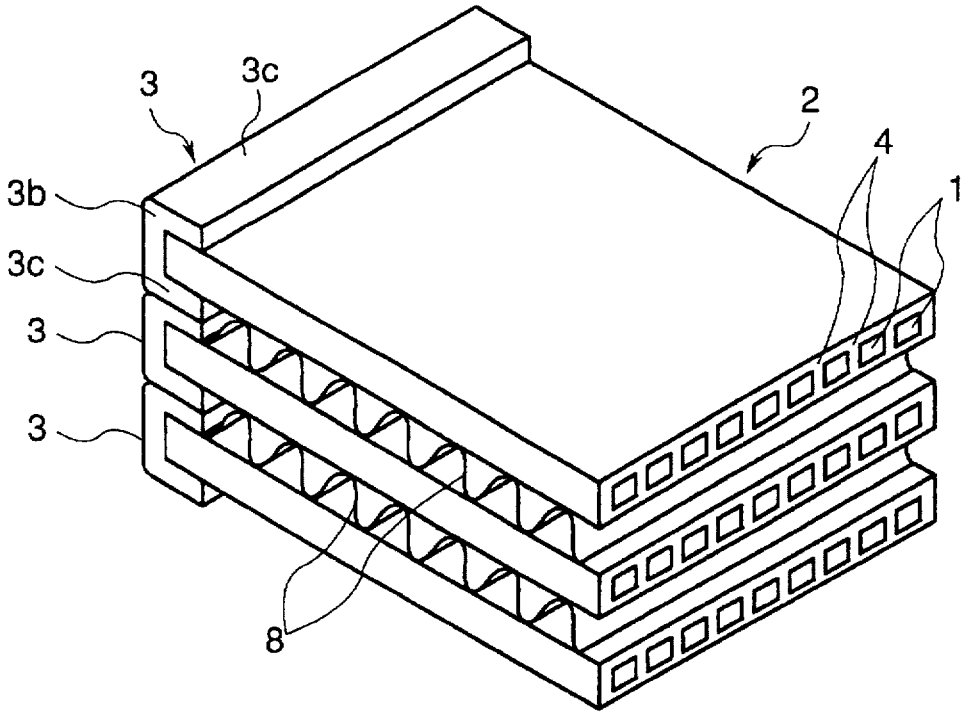
FIG. 10A is a perspective view of the fifth embodiment of a winding small tube apparatus of the present invention.
Figure 10B:
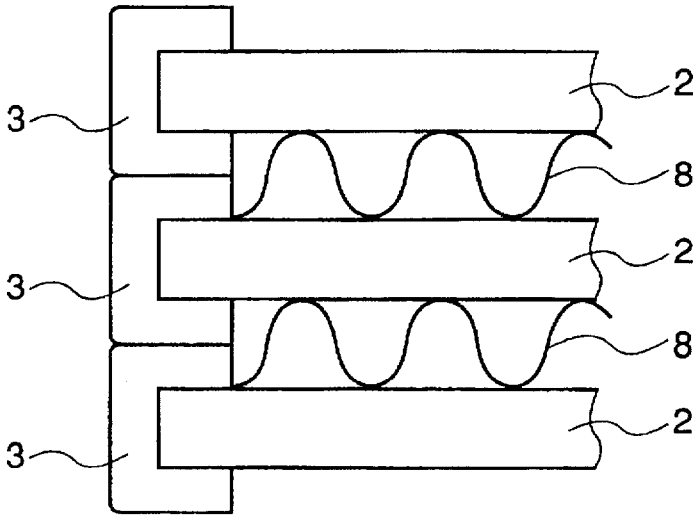
FIG. 10B is a cross-sectional view of the fifth embodiment of a winding small tube apparatus of the present invention.

FIGS. 10A and 10B show a perspective view and a cross-sectional view, respectively, of the fifth embodiment of a winding small tube apparatus of the present invention.

The fifth embodiment shows a case in which a plurality of the winding small tube apparatuses is combined. That is, it shows a case in which corrugated fins 8 of, for example, aluminum alloy are placed between the winding small tube apparatuses having the headers 3 attached to the end of the extruded flat tubed strip openings (openings not shown in figure), as shown in the previous embodiments, and in which the corrugated fins 8 and the extruded flat tubed strips 2 adjacent to each other are brazed together. In this way, by placing the fins between the plurality of the winding small tube apparatuses, the heat exchange efficiency for each apparatus is promoted.

Figure 11A:
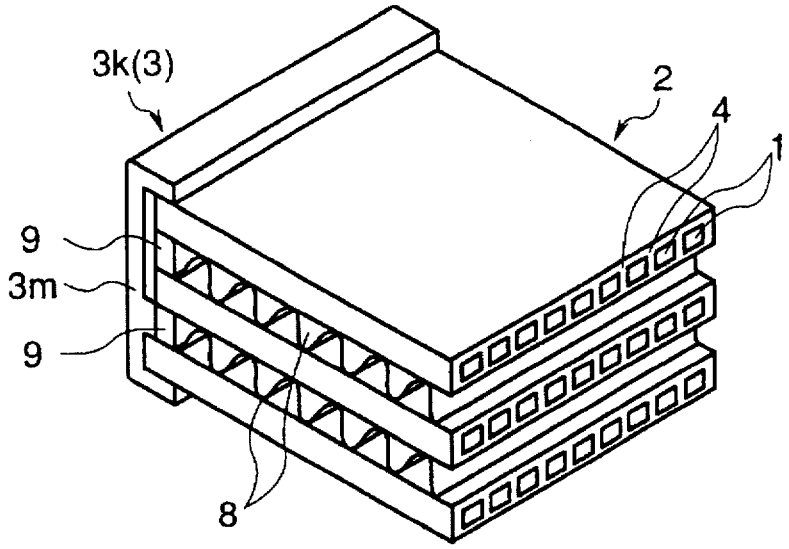
FIG. 11A is a perspective view of the sixth embodiment of a winding small tube apparatus of the present invention.
Figure 11B:
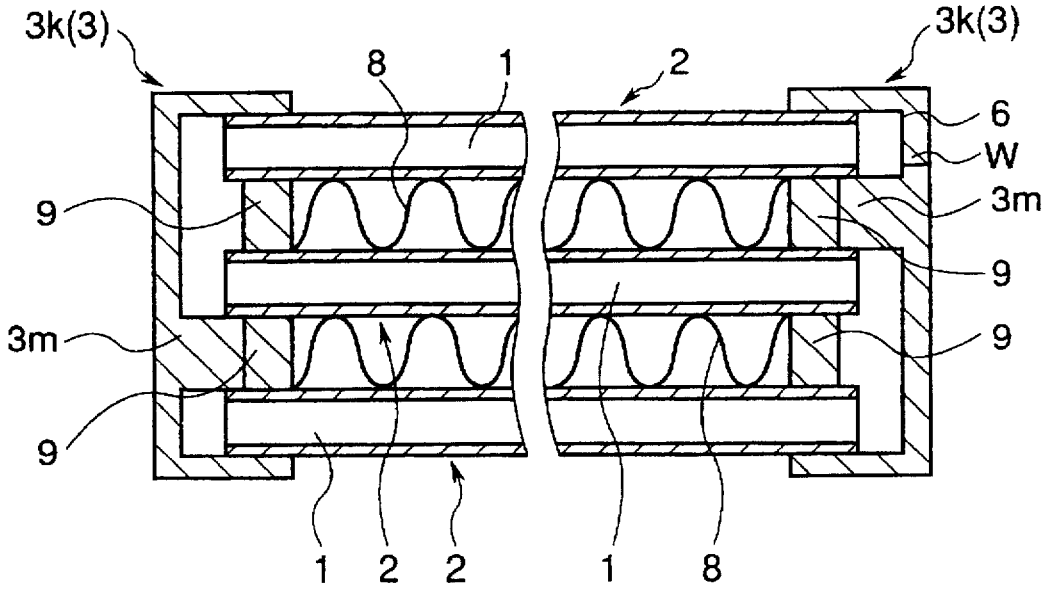
FIG. 11B is a cross-sectional view of the sixth embodiment of a winding small tube apparatus of the present invention.

FIGS. 11A and B show a perspective view and a cross-sectional view of the sixth embodiment of a winding small tube apparatus of the present invention.

The sixth embodiment shows a case in which the lumens 1 are connected to form a winding, serpentine channel by using a plurality of extruded flat tubed strips 2. That is, it shows a case in which closing blocks 9 are placed between a plurality of the extruded flat tubed strips 2 having a plurality of the openings leading to parallel lumens 1 and at the both ends of the extruded flat tubed strips 2. The header 3 is formed into a cap body **3*k* that encapsulates the entire outer end perimeter of the plurality of the extruded flat tubed strips 2, and wall protrusions 3*m* are attached at the inner bottom portion of the cap body 3*k* to face and attach to every other sealing block 9. In this formation, there is no need to cut out the partitions 4 at the openings to connect the lumens 1 of the entire apparatuses in a winding, serpentine fashion. Additionally, by placing the fins 8 between the extruded flat tubed strips adjacent to each other, the heat exchange efficiency of the cooling medium sealed inside each channel of the extruded flat tubed strips 2** is further promoted.

Next, this winding small tube apparatus of the present invention as a heat pipe is explained in the following examples.

EXAMPLE 1

First, an extruded flat tubed strip 2 of 4.0 mm in thickness and 32.0 mm in width with 14 openings leading to parallel lumens, with each opening separated by a partition 0.6 mm thick and with the distance of the edge of the opening to the outer perimeter being 1.0 mm (i.e. the cross-sectional area of the opening being 1.6 mm×2.0 mm), was cut 300 mm in length. Next, 2 mm of every other partition 4 of the extruded flat tubed strip 2 at both ends was cut such that 7 partitions at one end and 6 partitions at the other end, a total of 13 locations, were cut out. After this, two cold forged headers (U-shaped body **3*d* as shown in FIG. 5) of U-shaped aluminum alloy of each 1.0 mm in wall thickness and 32.0 mm in length were each clamped on to the each end of the extruded flat tubed strip 2 that has the cut-out 5. The inner surface portion of the U-shaped body 3*d* was tightly attached to the cut-out cross-sectional surface of the 6 locations of both the outer perimeter cut-out surface portion and the uncut portion of the partitions 4 of the extruded flat tubed strip 2. The length of the wrapped bonded portions (flanges 3*c*) in reference to the inner header surface and the flat surface of the extruded flat tubed strip 2 was each 5 mm. The tightly bonded portion of the extruded flat tubed strip 2 and the header 3 was attached by TIG welding. Furthermore, regarding the three locations of approximately 4 mm in length of the corresponding thickness of the both sides of the extruded flat tubed strip 2, TIG welding was amply applied to avoid outside leakage of the cooling medium. One of the 14 openings was made into a mouth for introducing and sealing in the cooling medium, and one of the two U-shaped bodies 3*d* was made to have a cooling medium mouth 6 at the corner of the header base portion 3*b***.

In the manner as described above, 13 locations on the winding small tube apparatus were cut out to form a winding channel, and a cooling medium, such as R134a ($CH_2FCF_3$), was introduced into the channel and sealed in by welding the mouth (indicated by W). A leakage test was conducted to confirm that the seal was complete. The capacity of the apparatus to function adequately as a heat pipe was also confirmed.

EXAMPLE 2

An aluminum alloy extruded flat tubed strip measuring 1.9 mm in thickness and 18.8 mm in width with 11 openings leading to parallel lumens each divided by a partition of 0.4 mm in thickness (edge of the opening to the outer perimeter of the strip was 0.4 mm) was cut to form an extruded flat tubed strip 2 of 240 mm in length. Every other partition 4 was cut by 1.4 mm at both ends such that five partitions at one end and five partitions at the other end, a total of 10 locations, were cut out. After this, two cold forged headers (cap body **3*f* as shown in FIG. 6) of cap-shaped aluminum alloy each 1.0 mm in thickness were tightly clamped and attached to the both ends of the extruded flat tubed strip 2 over the cut-out 5. The length of the tightly bonded wrapped portion in connection with the end part 3*e* of the header, i.e., the cap body 3*f*, and the flat portion of the extruded flat tubed strip 2 was each 5 mm when the inner bottom portion of the cap body 3*f* had good contact with the end surface of the extruded flat tubed strip 2. The attachment of the extruded flat tubed strip 2 and the header 3 was bonded by electron beam welding. One of the eleven openings was made to be a mouth for introducing the cooling medium, and one of the two cap bodies 3*f* had the cooling medium mouth 6 at a corner of the header base portion 3*b***.

In the manner as described above, 10 locations on the winding small tube apparatus were cut out to form a winding channel, and a cooling medium, such as R134a ($CH_2FCF_3$), was introduced into the channel and sealed in by welding the mouth (indicated by W). A leakage test was conducted to confirm that the seal was complete. The capacity of the apparatus to function adequately as a heat pipe was also confirmed.

EXAMPLE 3

An aluminum alloy extruded flat tubed strip and cold forged headers of aluminum alloy, dimensions of these strip and headers being the same as those in Example 2, were brazed and combined together with an anti-corrosive flux, which was a mixture of $KAlF_4$ and $K_2AlF_5 \cdot 2H_2O$.

In this way, 10 locations on the winding small tube apparatus were cut out to form a winding, serpentine channel, and a cooling medium, such as R134a ($CH_2FCF_3$), was introduced into the channel and sealed in by welding the nozzle (indicated by W). A leakage test was conducted to confirm that the seal was complete. The capacity of the apparatus to function adequately as a heat pipe was also confirmed.

Figure 12A:
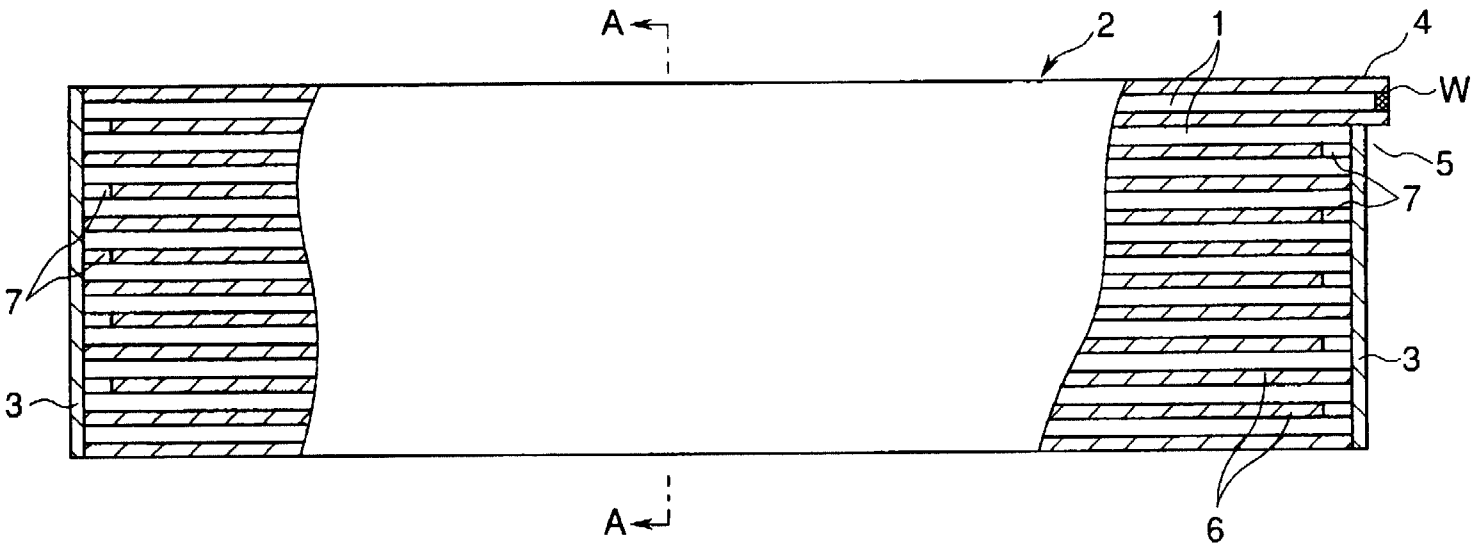
FIG. 12A shows a part of the seventh embodiment of a winding small tube apparatus of the present invention as a cross-sectional schematic drawing.
Figure 12B:
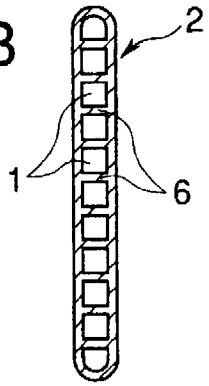
FIG. 12B shows a part of the seventh embodiment of a winding small tube apparatus of the present invention as an A—A cross-sectional drawing.
Figure 13:
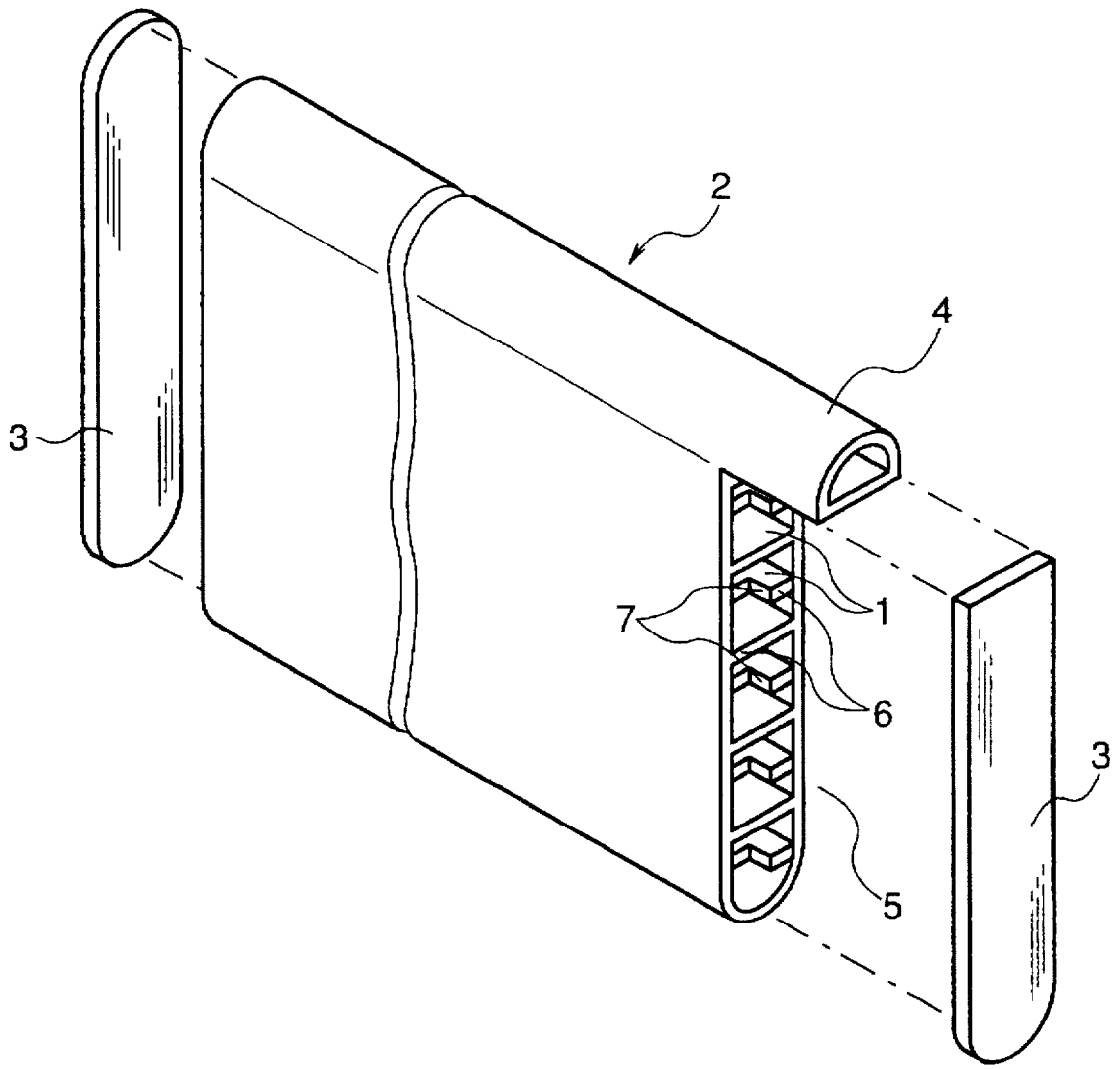
FIG. 13 shows an exploded perspective view of the seventh embodiment of a winding small tube apparatus of the present invention.

FIGS. 12A and 12B show a part of the seventh embodiment of a winding small tube apparatus of the present invention as a cross-sectional schematic drawing and an A—A cross-sectional view, respectively; and FIG. 13 is an exploded perspective view of a winding small tube apparatus.

The winding small tube apparatus of the present invention is formed mainly by an extruded flat tubed strip 2 having a plurality of openings leading to parallel lumens 1 and a header 3 that is attached to an end of this extruded flat tubed strip 2, and this apparatus is structured in a way such that a cooling medium is made to be introduced into the channel, formed by connecting the lumens, via a cooling medium nozzle 4 provided on one of the openings of the extruded flat tubed strip 2.

In this instance, the above-mentioned extruded flat tubed strip 2 is formed by an aluminum alloy extruded material. The one end of this extruded flat tubed strip 2 has one opening portion, optionally chosen for forming a cooling medium nozzle 4 (located at the top end in FIG. 12A), left uncut and the rest of the opening portions are cut away, and the header 3 is attached to this cut-out portion 5.

Furthermore, linking portions 7 are formed by cutting out every other partition 6 near the openings at the end, which is to be covered by the header 3, to connect the lumens. It is not necessary that the linking portion 7 be a part of the partition 6 of the lumens 1; the lumens 1 may be connected in a winding or serpentine fashion by cutting out every other partition 6 and the outer surface extending portion of the partition 6, which is a wall portion that extends from the partition 6 to the surface of the extruded flat tubed strip 2.

The above-mentioned header 3 is formed by a plate of, for example, aluminum alloy that tightly connects to an end of the extruded flat tubed strip 2. The header 3 is attached to one end, which has the cut-out portion 5, and another header to the other end to seal the lumens 1 to form a sealed winding, serpentine channel; and in this condition, after the cooling medium is introduced into the channel via the cooling medium nozzle 4, the mouth of the cooling medium nozzle 4 is sealed by welding (indicated by W) to form a winding small tube apparatus. This type of a winding small tube apparatus can be used as a heat pipe.

In the above embodiment, an explanation was given for a case in which the header 3 was formed by a plate material, but the linking portion 7 may be also provided by cutting out the partitions 6 and the outer surface extending portion of the partition 6; and in this instance, the header 3 may be made into a U cross-sectional shape body comprising a header base portion for tightly sealing the end portion of the extruded flat tubed strip 2 and a flange portion that bends away from this header base portion at both ends for clamping the flat portions of the extruded flat tubed strip 2. Furthermore, the header that connects to an end of the extruded flat tubed strip 2 that has no cut-out portion 5 may be formed into a cap shape body that comprises a header base portion for sealing tightly the end of the extruded flat tubed strip 2 and an edge part for encapsulating the outer end perimeter of the extruded flat tubed strip 2.

The extruded flat tubed strip 2 and the header 3 formed in the above manner may be either welded, brazed, or bonded together; and for instance, in the case of brazing, it would be desirable to connect them by using an anti-corrosive flux of either $KF+AlF_3$, $KAlF_4$, $K_3AlF_6$, or $K_2AlF_5$. $H_2O$ or a combination thereof. In this instance, it would be desirable to coat the anti-corrosive flux at least on the extruded flat tubed strip 2 or the header 3 beforehand. If the material is aluminum, it would be desirable to coat Si and an anti-corrosive flux of, for example, a combination of $KAlF_4$,+ $K_3AlF_6$ on the metallic surface where the connection is going to be made. By connecting the extruded flat tubed strip 2 and the header 3 by brazing in the above manner, only a small amount of brazing material is necessary and the formation of the winding small tube apparatus is facilitated; and hence, a danger of brazing material flowing into the channel to block the passage is eliminated.

According to the winding small tube apparatus of the present invention as described above, the radius of the winding curvature can be made very small since there is no limit like that of bending a small pipe. For instance, it would be possible to realize a radius of the winding curvature that is ½ the thickness of the partition 6 (such as 0.1 mm). Moreover, it would be possible to form an opening of the extruded flat tubed strip that has a diameter of less than 1 mm, such as 0.3 mm. Therefore, the overall height can be reduced and the heat exchange efficiency can be promoted.

Figure 14:
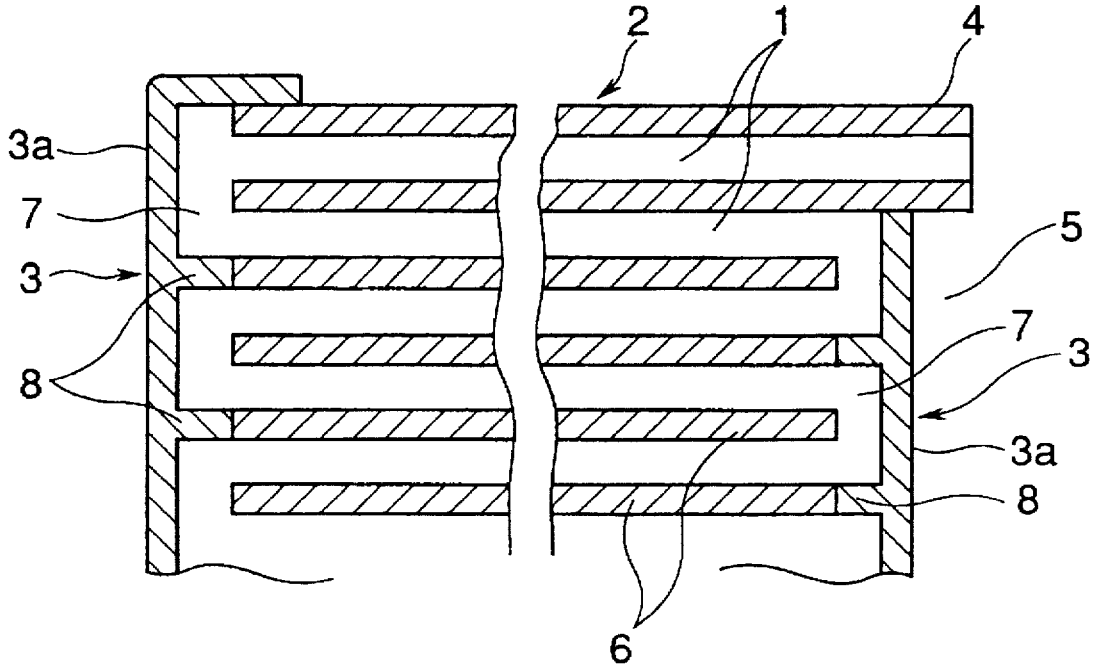
FIG. 14 shows a cross-sectional view of the eighth embodiment of a winding small tube apparatus of the present invention.

FIG. 14 shows a cross-sectional view of the eighth embodiment of a winding small tube apparatus of the present invention.

The eighth embodiment shows a case in which the lumens 1 are connected to form a winding channel without cutting out the partitions 6 at the openings of the extruded flat tubed strip 2. That is, it shows a case in which the header 3 is formed into a cap body 3*a* that encapsulates the outer end perimeter of the extruded flat tubed strip 2, excluding the cooling medium nozzle 4, and in which a linking portion is formed by providing wall protrusions 8 at the inner bottom portion of the cap body 3*a*, whereby the protrusions 8 face and attach to every other partition 6 at the openings. By structuring the apparatus in this way, the need to cut out the partitions 6 at the openings is done away with, and, hence, the manufacturing steps are reduced; and moreover, the formation of the winding small tube apparatus is facilitated and the cost is reduced.

Concerning the above eighth embodiment, the other parts are the same as those in the seventh embodiment, and hence, further explanation will be abbreviated. Moreover, it would be possible to have the linking portion in both the partitions 6 at the openings and the header 3.

Furthermore, in the above-mentioned embodiment, an explanation was given for the case in which the cooling medium nozzle 4 protrudes more than the other opening portions, but it would also be possible to have the cooling medium nozzle 4 more recessed than the other opening portions.

Figure 15A:
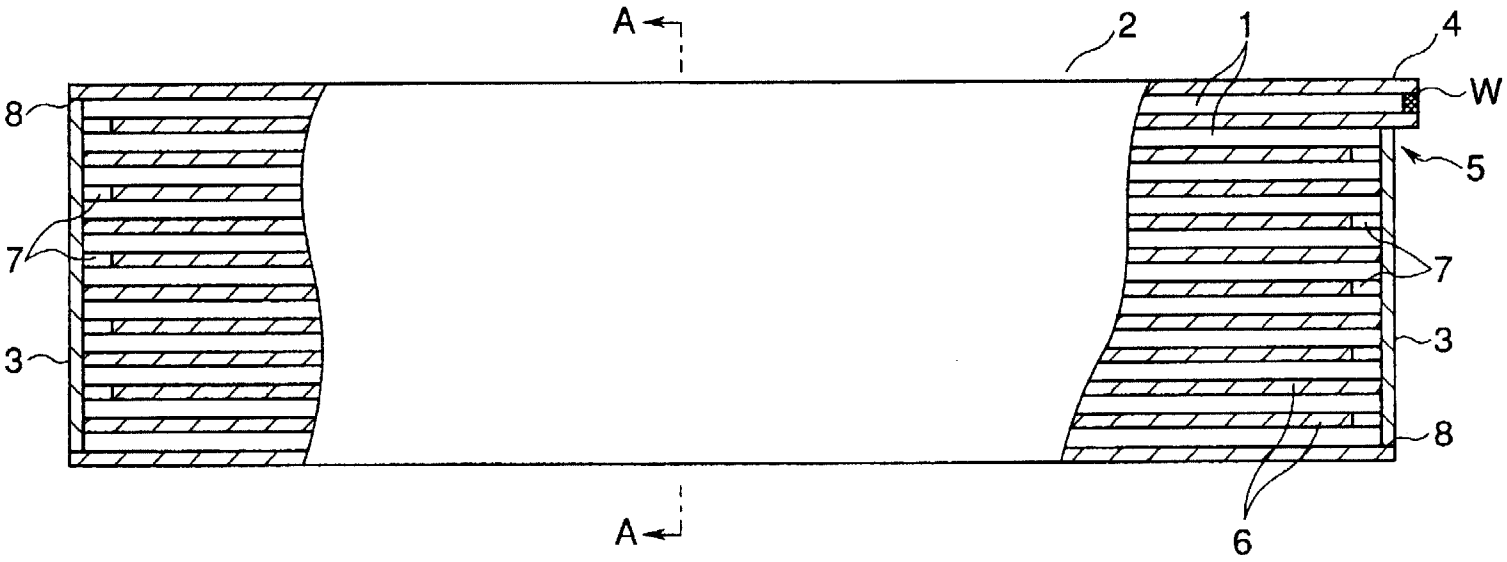
FIG. 15A shows a part of the ninth embodiment of a winding small tube apparatus of the present invention as a cross-sectional schematic drawing.
Figure 15B:
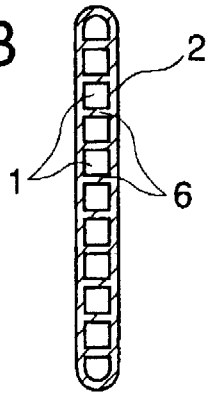
FIG. 15B shows a part of the ninth embodiment of a winding small tube apparatus of the present invention as an A—A cross-sectional drawing.
Figure 16A:
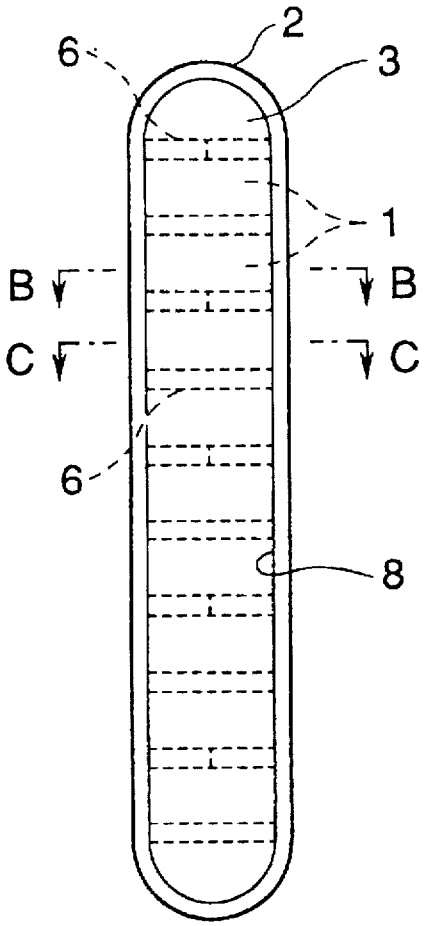
FIG. 16A is a side surface view of the ninth embodiment of a winding small tube apparatus of the present invention.
Figure 16B:
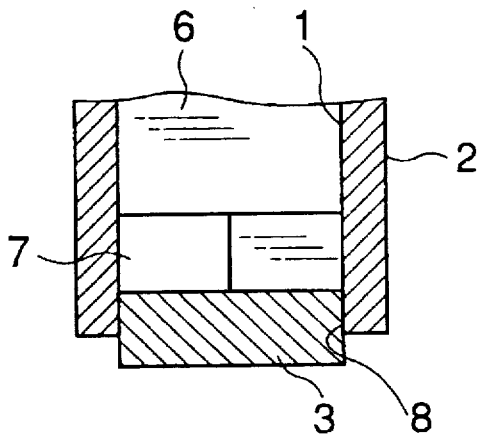
FIG. 16B is a B—B cross-sectional view of the ninth embodiment of a winding small tube apparatus of the present invention.
Figure 16C:
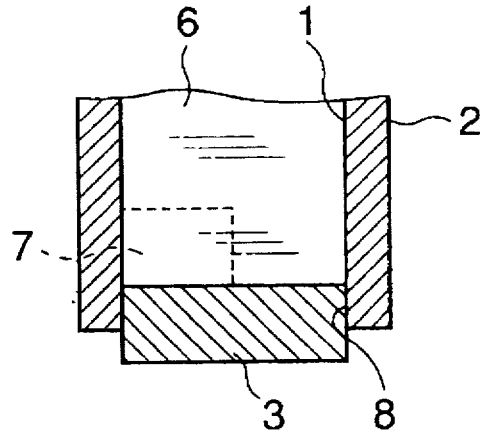
FIG. 16C is a C—C cross sectional view of the ninth embodiment of a winding small tube apparatus of the present invention.

FIGS. 15A and 15B show a part of the ninth embodiment of a cross-sectional schematic drawing of a winding small tube apparatus of the present invention and an A—A cross-sectional view, respectively; and FIGS. 16A to 16C show a side view, a B—B view, and a C—C view, respectively, of the winding small tube apparatus.

The winding small tube apparatus of the present invention comprises mainly an extruded flat tubed strip 2 having a plurality of openings leading to parallel lumens 1 and a header that is attached to an end of this extruded flat tubed strip 2. In this instance, the apparatus is structured to have a cooling medium introduced into the channel, formed by connecting the lumens 1, through a cooling medium nozzle 4 provided on one of the openings of the extruded flat tubed strip 2.

The above-mentioned extruded flat tubed strip 2 is formed by an aluminum alloy extruded material. One end of this extruded flat tubed strip 2 has all the opening end portions cut out, other than the opening end portion where the cooling medium nozzle 4 is to be structured, and cut-out level portions 8 are provided with respect to this cut-out portion 5 by further cutting out the partitions other than the extreme side wall opposite to where the cooling medium nozzle is to be located.

Furthermore, a linking portion 7 as indicated on FIG. 16B is provided to link the lumens in a winding, serpentine fashion by cutting out every other end portion of the partitions 6 at the openings on the end that is to be attached to the header 3. The linking portion 7 does not need to be formed by cutting away a part of the partitions 6 at the openings 1 in the width direction, and, as shown by dotted lines in FIG. 16B, the entire width region of the partitions 6 may be cut away.

The above-mentioned header 3, formed with aluminum alloy, has, for example, a slightly smaller outer perimeter contour than the inner surface contour of the cut-out level portion 8 provided on the extruded flat tubed strip 2. This header 3 is inserted and attached within the cut-out level portion 8 provided on the both ends of the extruded flat tubed strip 2 to connect the lumens 1 to form a winding, serpentine channel; and in this condition, after the cooling medium is introduced into the channel via the cooling medium nozzle 4, the cooling medium nozzle 4 is sealed shut by welding to form the winding small tube apparatus. Therefore, a tight seal between the extruded flat tubed strip 2 and the header is assured, and furthermore, because the outer perimeter of the header is placed within the outer perimeter surface of the extruded flat tubed strip 2, the whole structure of the winding small tube apparatus is made thin with a flat surface.

The extruded flat tubed strip 2 formed in the above manner and the header 3 may be either welded, brazed, or bonded together, and for instance, in the case of brazing, it would be desirable to connect them by using an anti-corrosive flux of either $KF+AlF_3$, $KAlF_4$, $K_3AlF_6$, or $K_2AlF_5$. $H_2O$ or a combination thereof. In this instance, it would be desirable to coat the anti-corrosive flux at least on the extruded flat tubed strip 2 or the header 3 beforehand. If the material is aluminum, it would be desirable to coat Si and an anti-corrosive flux of, for example, a combination of $KAlF_4$,+$K_3AlF_6$ on the metallic surface where the connection is going to be made.

By connecting the extruded flat tubed strip 2 and the header 3 by brazing in the above manner, only a small amount of brazing material is necessary and the formation of the winding small tube apparatus is facilitated; and hence, a danger of brazing material flowing into the channel to block the passage is eliminated and the property of high heat exchange efficiency is promoted.

According to the winding small tube apparatus of the present invention as described above, since there is no limit like that of bending a small pipe, the radius of the winding curvature can be made very small. For instance, it would be possible to realize a radius of the winding curvature that is ½ the thickness of the partition 6 at the opening (such as 0.1 mm). Moreover, it would be possible to form an opening of the extruded flat tubed strip that has a diameter of less than 1 mm, such as 0.3 mm.

In the above embodiment, one of the openings is made into the cooling medium nozzle 4 by cutting out the opening end portions of the extruded flat tubed strip 2, but it is not always necessary to provide the cooling medium nozzle 4 on the extruded flat tubed strip 2; a cooling inlet may be provided on the header 3.

Figure 17A:
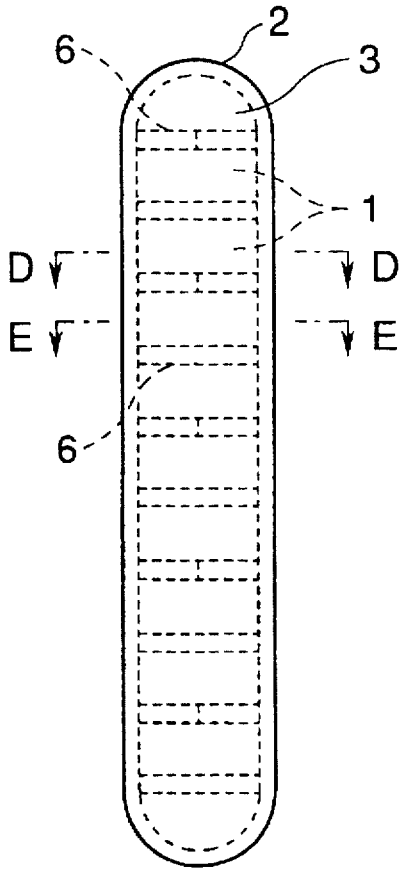
FIG. 17A is a side surface view of the tenth embodiment of a winding small tube apparatus of the present invention.
Figure 17B:
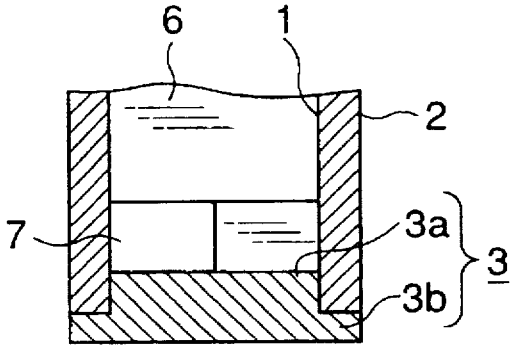
FIG. 17B is a B—B cross-sectional view of the tenth embodiment of a winding small tube apparatus of the present invention.
Figure 17C:
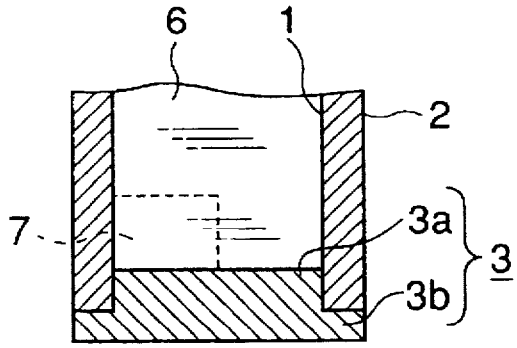
FIG. 17C is a C—C cross sectional view of the tenth embodiment of a winding small tube apparatus of the present invention.

FIGS. 17A to 17C show a side view, a D—D cross-sectional view, and an E—E cross-sectional view, respectively, of the tenth embodiment of a winding small tube apparatus of the present invention.

The tenth embodiment shows a case in which the attachment of the extruded flat tubed strip 2 and the header 3 is further assured. That is, the embodiment shows a case in which the header 3 is formed into a hat cross-sectional shape, which comprises an inner connecting portion 3*a* connecting to the inner surface of the cut-out level portion 8 and an outer connecting portion 3*b* connecting to the end surface of the extruded flat tubed strip 2. By forming the header 3 into a hat cross-sectional shape, the surface connecting to the extruded flat tubed strip 2 can be increased to assure better contact between the extruded flat tubed strip 2 and the header 3.

The other parts of the tenth embodiment are the same as those in the ninth embodiment, and hence, further explanation on these parts will not be given.

Figure 18A:
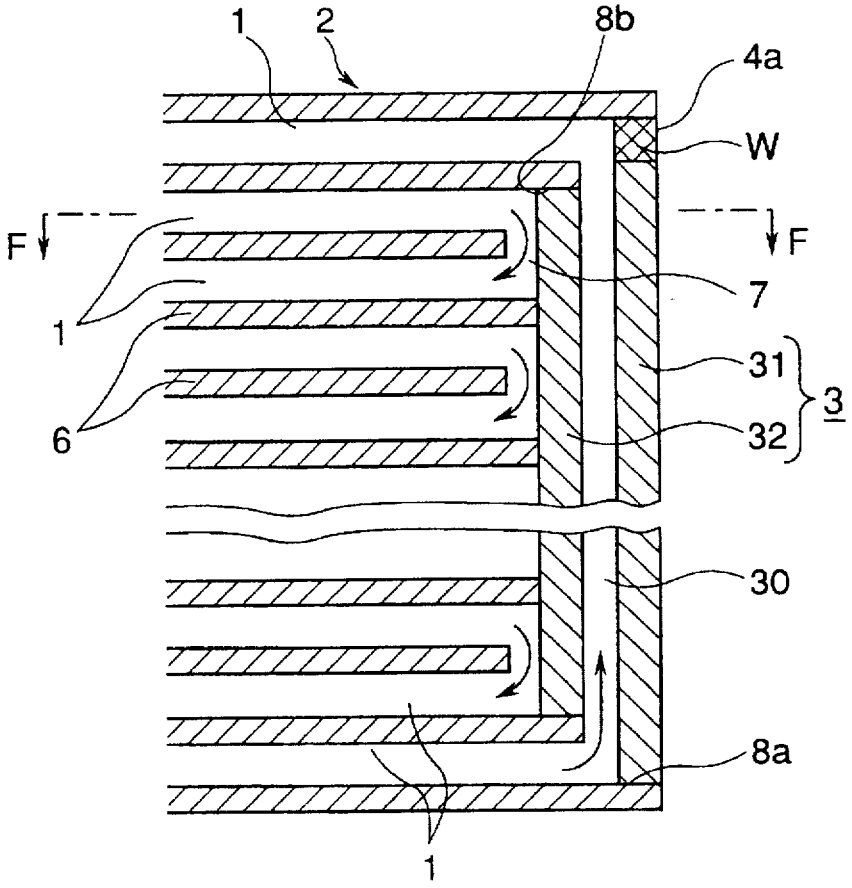
FIG. 18A shows a cross-sectional view of the eleventh embodiment of a winding small tube apparatus of the present invention.
Figure 18B:
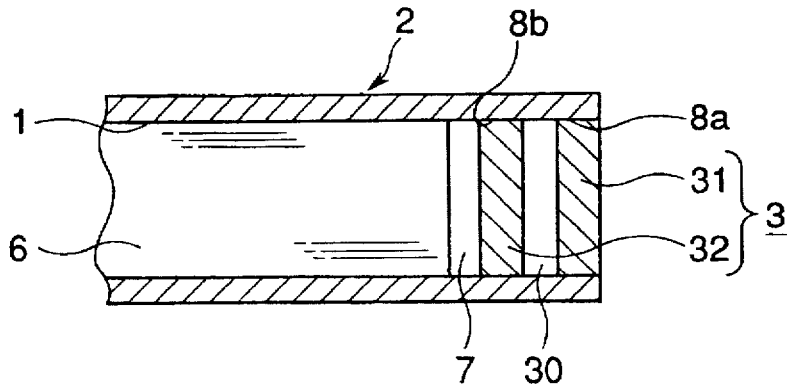
FIG. 18B shows an F—F cross-sectional view of the eleventh embodiment of a winding small tube apparatus of the present invention.

FIGS. 18A and 18B show a cross-sectional view and an F—F cross sectional view, respectively, of the eleventh embodiment of a winding small tube apparatus of the present invention.

The eleventh embodiment shows a case in which the heat exchange efficiency is further increased by linking the lumens 1 at the both extreme sides of the extruded flat tubed strip 2 and circulating the cooling medium.

With regard to the eleventh embodiment, the above-mentioned extruded flat tubed strip 2 is provided with an outer cut-out level portion 8*a* by leaving only the outer perimeter wall at the extreme end sides uncut and with an inner cut-out level portion 8*b* by further cutting out the partitions 6 at the openings other than those partitions at the extreme end sides and the penultimate-extreme sides of the extruded flat tubed strip 2; the inner lumens 1 are connected to the extreme side lumens 1 of this outer cut-out level portion 8*a*. Furthermore, a linking portion 7 is provided by cutting out every other partition 6 at the openings of the inner lumens 1 of the cut-out level 8*b*, to form, as in the ninth embodiment, a winding, serpentine channel.

On the other hand, the header 3 is inserted and connected to the outer cut-out level portion 8*a* and is formed by an outer portion header body 31 whose outer perimeter surface is within the outer perimeter surface of the extruded flat tubed strip 2 and an inner portion header body 32, which is inserted and connected to the inner cut-out level portion 8*b* that is provided on the partitions 6 at the openings other than those partitions on the both extreme sides of the extruded flat tubed strip 2. In this instance, the outer portion header body 31 may be formed into a hat cross-sectional shape, same as the header 3 in the tenth embodiment.

In structuring the extruded flat tubed strip 2 and the header 3 in the manner as indicated above, the inner portion header body 32 is inserted and attached to the inner cut-out level portion 8*b* of the extruded flat tubed strip 2, the outer portion header body 31 is inserted and attached to the outer cut-out level portion 8*a*, the lumens 1 of the extruded flat tubed strip 2 are sealed, and the inner portion header body 32 and the outer portion header body 31 coordinate to form a linking channel 30 that links the lumens 1 at the both extreme sides of the extruded flat tubed strip 2.

In the outer portion header body 31, a cooling medium nozzle 4*a* is provided; and after a cooling medium is introduced into the channel, formed by connecting the lumens 1, via this cooling medium nozzle 4*a*, the cooling medium nozzle 4*a* is closed and sealed by welding (W).

According to the winding small tube apparatus of the eleventh embodiment as described above, all the lumens 1 are linked together without an end, and therefore, after the cooling medium has flowed to transport heat through the winding channel from one side of the apparatus, it circulates back from the other side via the linking channel 30 between the two header bodies to the original side of the apparatus. Therefore, there is no interruption of the cooling medium, and the heat exchange efficiency according to the heat transport of the cooling medium is promoted.

Figure 19:
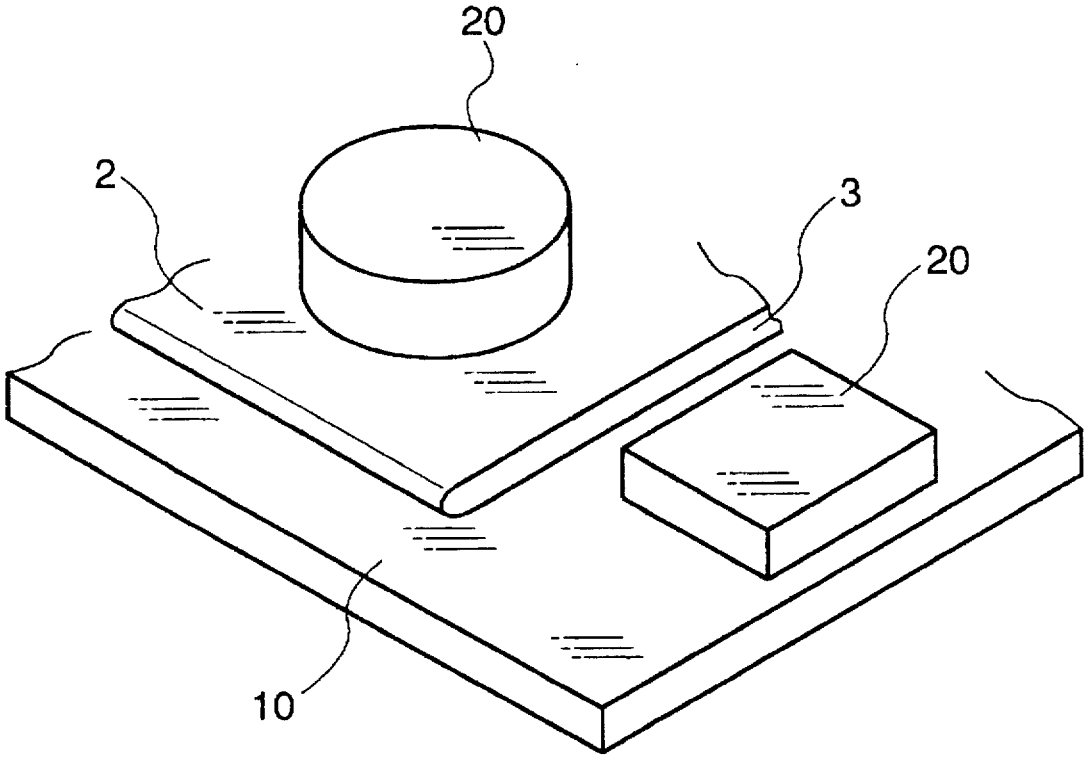
FIG. 19 is a perspective view of a use of a winding small tube apparatus of the present invention.

The winding small tube apparatus of the present invention as described above can be used as a heat pipe, and as shown in FIG. 19, it can be bonded on to the surface of a print substrate board 10 since the apparatus has no obstructive elements to hinder a good surface contact. In this instance, the semiconductor devices 20 are either placed on the winding small tube apparatus or on a print substrate board proximal to the winding small tube apparatus. In this way, heat from the semiconductor devices 20 can be absorbed and transferred by the winding small tube apparatus, and heat-induced dysfunction of the semiconductor devices 20 can be prevented.

In the above-mentioned embodiment, an explanation is given in which the winding small tube apparatus of the present invention is attached to the print substrate 10 to cool the semiconductor devices 20, but it is possible to use this winding small tube apparatus of the present invention to cool other devices that generate heat.

Next, a manufacturing method of a winding small tube apparatus of the present invention is explained in reference to FIGS. 20A to 20E.

Figure 20A:
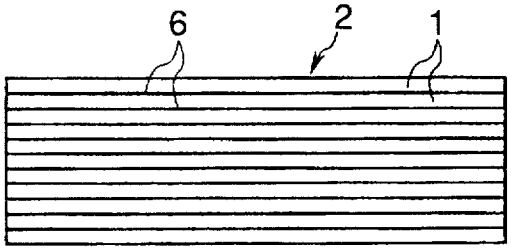
FIGS. 20A to 20E show a manufacturing process of a winding small tube apparatus of the present invention.

First, as shown in FIG. 20A, an extruded flat tubed strip, cut at a pre-determined size, is prepared. Next, all of the opening portions are cut except one part at an end (cooling medium nozzle 4) (see FIG. 20B). In this instance, linking portions 7 are formed by cutting out every other partition 6 at the openings at the end side proximal to the header 3. Next, the header 3 is attached by brazing and such to one end portion with the cut-out 5 of the extruded flat tubed strip 2 and another header to the other side to connect the lumens 1 to form a winding channel (see FIG. 20C). Then, after introducing a cooling medium into the channel via the cooling medium nozzle 4 (see FIG. 20D), the mouth of the cooling medium nozzle 4 is sealed by welding (indicated by W) to complete the winding small tube apparatus (see FIG. 20E).

Figure 20B:
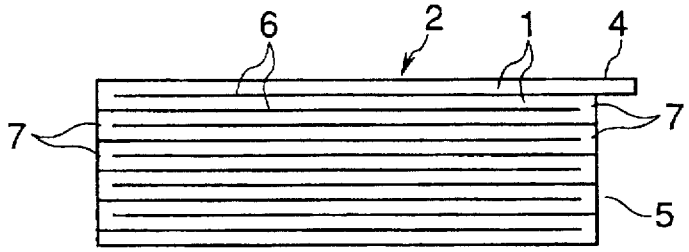
Figure 20C:
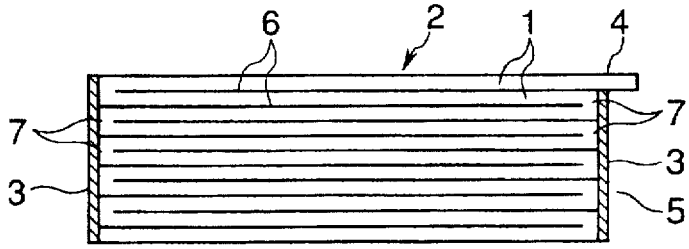
Figure 20D:
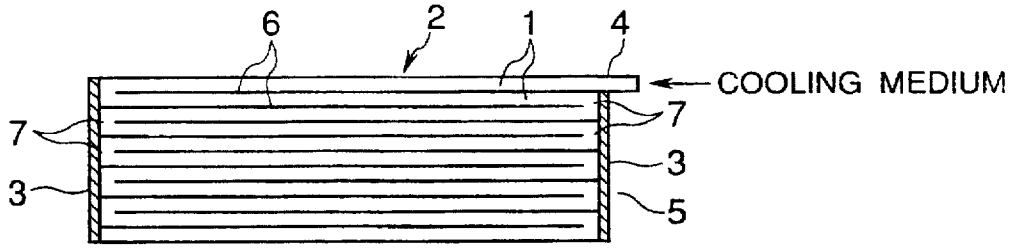
Figure 20E:
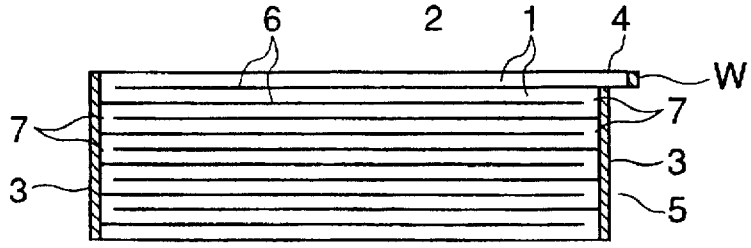

Concerning the cutting process in FIG. 20B, the partitions 6 may need not be cut away. Instead the linking portions 7 may be provided in the header 3; and then the attachment of the header 3, the introduction of the cooling medium, and the sealing of the cooling medium nozzle 4 may be conducted. Furthermore, if the cooling medium nozzle 4 is to be made recessed with respect to the other openings, a portion of the cooling medium insertion tube 4 may be cut away.

By manufacturing the winding small tube apparatus in the above manner, the need to prepare a separate cooling medium nozzle and to remove this nozzle after the medium is introduced is eliminated, thereby increasing productivity. Furthermore, because less parts are needed, manufacturing costs are reduced.

The winding small tube apparatus of the present invention as explained above has the following effects:

(1) According to the winding small tube apparatus of the present invention, since a part or a whole of the partition of the extruded flat tubed strip having a plurality of openings leading to parallel lumens is cut out, or the lumens are connected in a winding, serpentine fashion by utilizing the protrusions placed on the header, a small winding channel is formed on the same plane surface. Also, there is no limit like that of bending a small pipe, and consequently, the radius of the winding curvature can be made very small. Hence, the overall height of the apparatus is lowered, and the heat exchange efficiency is promoted.

Further, this invention of the winding small tube apparatus has a highly efficient heat exchanging characteristic because it is formed by joining the extruded flat tubed strip and the header where they can be joined easily and with reduced brazing material, eliminating the danger of brazing material flowing into the channel and causing a blockage.

(2) Further, according to the present invention, by forming the header into a cap body that covers the outer end perimeter portion of the extruded flat tubed strip and, at the same time, by having protrusions on the inner bottom side of the cap body that join with every other partition of the lumens, the lumens are linked together to form a winding channel without the need to cut out the partitions at the openings, thereby contributing to lowering manufacturing costs, in combination with (1).

(3) Further, by having sealing blocks placed between the extruded flat tubed strips at each end, by forming the header into a cap body that covers the outer end perimeter of a plurality of the extruded flat tubed strips, and by having protrusions on the inner bottom side of the cap body in which these protrusions join with every other sealing block, it becomes possible to link the lumens to form a winding channel in a plurality of extruded flat tubed strips. Hence, this makes it possible to increase the heat exchange property. Moreover, because the extruded flat tubed strips and the header are connected, less brazing material is required, and a danger of brazing material flowing into the channel is eliminated.

(4) Further, according to the present invention, by forming one of the openings of the extruded flat tubed strip into a cooling medium nozzle, the need for attaching and detaching a separate pipe for introducing and sealing in the cooling medium is eliminated. Therefore, the manufacturing process is facilitated and a reduction in the number of parts is accomplished.

(5) Further, the winding small tube apparatus of the present invention is able to assure a tight connection between the extruded flat tubed strip and the header by the insertion of the header into the cut-out level portion, which has the outer wall of the extruded flat tubed strip uncut. Moreover, this invention is able to make the thickness of the body very thin and, at the same time, make the attachment to the print substrate board easy and in single flat surface by positioning the outer surface of the header recessed inside the extruded flat tubed strip.

(6) Still further, according to the winding small tube apparatus of the present invention, the header is inserted and attached to the outer cut-out level portion, which leaves the outer wall on the end side of the extruded flat tubed strip uncut, and the header is made of the outer header body where the outer wall of the header is recessed with respect to the outer surface of the extruded flat tubed strip and is made of the inner header body, which is inserted and attached to the inner cut-out level portion in the partitions at the openings other than those at the end side of the extruded flat tubed strip, such that the outer header body and the inner header body coordinate to form a linking channel to link the lumens on the extreme sides of the extruded flat tubed strip. The cooling medium sealed inside the channel is able to circulate from the extreme side of the apparatus back to the other extreme side via the linking channel in the header after the medium has flowed and transported heat through each of the lumens in a winding fashion from one side of the apparatus to the other. Therefore, the cooling medium is able to flow freely and the heat exchange efficiency is raised.

(7) In accordance with the manufacturing method of the winding small tube apparatus, a winding small tube apparatus is constructed by cutting out one or more of the end of the opening portion of the extruded flat tubed strip, connecting the parallel lumens to form a winding, serpentine channel by attaching a header to each of the end where the cut-out portions and uncut portions are present, introducing a cooling medium through one of the openings, and closing the mouth of this opening.

What is claimed is:

1. A winding sealed small tube apparatus comprising:

an extruded flat tubed strip having a plurality of openings leading to parallel lumens;

a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein each successive pair of said parallel lumens adjoining each other are connected alternately at said end and said opposite end by having a portion of a partition that separates said openings of said parallel lumens adjoining each other cut out, and each of said end and said opposite end is covered with said respective first and second header to form a continuous winding sealed channel, whereby a cooling medium introduced in said channel is completely sealed inside.

2. The winding sealed small tube apparatus of claim 1, wherein said extruded flat tubed strip has a plurality of protrusions on an outer surface.

3. The winding sealed small tube apparatus of claim 1, wherein each of said first and second header is a block body that tightly seals each end of said extruded flat tubed strip.

4. The winding sealed small tube apparatus of claim 1, wherein each of said first and second header tightly has a "U" cross-section for clamping on to the flat portion of said extruded flat tubed strip.

5. The winding sealed small tube apparatus of claim 1, wherein each of said first and second header tightly seals each end of said extruded flat tubed strip and is a cap body that covers an end surface portion of said extruded flat tubed strip.

6. The winding sealed small tube apparatus of claim 1, wherein a plurality of said winding small tube apparatuses are stacked together with fins situated in between said winding small tube apparatuses.

7. A winding sealed small tube apparatus comprising:

an extruded flat tubed strip having a plurality of openings leading to parallel lumens;

a first header for connecting to an end of said extruded flat tubed strip to cover and tightly seal said end;

second header for connecting to an opposite end of said extruded flat tubed strip to cover and tightly seal said opposite end; the opposite end being opposite to said end; and wherein each successive pair of said parallel lumens adjoining each other are connected alternately at said end and said opposite end by having a partition at said openings of said parallel lumens adjoining each other cut out to the surface of the extruded flat tubed strip, and each of said end and said opposite end is covered with said respective first and second header to form a continuous winding sealed channel, whereby a cooling medium introduced in said channel is completely sealed inside.

8. The winding sealed small tube apparatus of claim 7, wherein said extruded flat tubed strip has a plurality of protrusions on an outer surface.

9. The winding sealed small tube apparatus of claim 7, wherein each of said first and second header is a block body that tightly seals each end of said extruded tubed strip.

10. The winding sealed small tube apparatus of claim 7, wherein each of said first and second header has a "U:" cross-section for clamping on to the flat portion of said extruded flat tubed strip.

11. The winding sealed small tube apparatus of claim 7, wherein each of said first and second header is a cap body that covers an end surface portion of said extruded flat tubed strip.

12. The winding sealed small tube apparatus of claim 7, wherein at least one of said first and second header has a sealing portion for sealing an end surface of said extruded flat tubed strip and a linking channel for linking said parallel lumens at the two sides of said extruded flat tubed strip.

13. The winding sealed small tube apparatus of claim 7, wherein a plurality of said winding small tube apparatuses are stacked together with fins situated in between said winding small tube apparatuses.

14. A winding sealed small tube apparatus comprising:

an extruded flat tubed strip having a plurality of openings leading to parallel lumens; and a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein said first header is formed as a cap body for covering said end of said extruded flat tubed strip and has protruding partitions at the inner bottom side of said cap body for connecting to every other partition of said parallel lumens to form a continuous winding sealed channel, whereby a cooling medium introduced in said channel is completely sealed inside.

15. A winding sealed small tube apparatus including a stack of extruded flat tubed strips, characterized in that:

a plurality of sealing blocks are placed at the same end of and between extruded flat tubed strips of said stack, each strip having a plurality of openings leading to parallel lumens;

a first header as a cap body is formed to cover and tightly seal an end of said stack of extruded flat tubed strips;

a second header is formed to cover and tightly seal an opposite end of said stack of extruded flat tubed strips, the opposite end being opposite to said end; and an inner surface of said cap body is disposed with protrusions that adjoin every other one of said sealing blocks, whereby a cooling medium introduced into said apparatus is completely sealed inside said apparatus.

16. The winding sealed small tube apparatus of claim 15, characterized further in that a fin is placed between a pair of adjacently stacked strips of said stack of extruded flat tubed strips.

17. The winding sealed small tube apparatus of claim 1, 2, 3, 4, 5, 6, 7, 8, 9, 10, 11, 12, 13, 14 or 16, wherein each extruded flat tubed strip is constituted by an aluminum alloy extruded material.

18. The winding sealed small tube apparatus of claim 1, 2, 3, 4, 5, 6, 7, 8, 9, 10, 11, 12, 13, 14, 15 or 16, wherein each extruded flat tubed strip and said first and second header are brazed with an anti-corrosive flux.

19. The winding sealed small tube apparatus of claim 1, 2, 3, 4, 5, 6, 7, 8, 9, 10, 11, 12, 13, 14, 15 or 16, wherein each extruded flat tubed strip is constituted by an aluminum alloy extruded material; and said extruded flat tubed strip and said first and second header are brazed with an anti-corrosive flux.

20. The winding sealed small tube apparatus of claim 1, 2, 3, 4, 5, 6, 7, 8, 9, 10, 11, 12, 13, 14, 15 or 16, wherein said extruded flat tubed strip and said first and second header are brazed with an anti-corrosive flux; and said anti-corrosive flux is coated beforehand at least on said extruded flat tubed strip or said first and second header.

21. The winding sealed small tube apparatus of claim 1, 2, 3, 4, 5, 6, 7, 8, 9, 10, 11, 12, 13, 14, 15 or 16, wherein each extruded flat tubed strip is constituted by an aluminum alloy extruded material;

said extruded flat tubed strip and said first and second header are brazed with an anti-corrosive flux; and said anti-corrosive flux is coated beforehand at least on said extruded flat tubed strip or said first and second header.

22. A winding sealed small tube apparatus comprising:

an extruded flat tubed strip having a plurality of openings leading to parallel lumens;

a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein each successive pair of said parallel lumens adjoining each other are connected alternately at said end and said opposite end by having a portion of a partition that separates said openings of said parallel lumens adjoining each other cut out, and each of said end and said opposite end is covered with said respective first and second header to form a continuous winding sealed channel wherein at least one of said first and second header has a sealing portion for sealing an end surface of said extruded flat tubed strip and a linking channel for linking said parallel lumens at the two sides of said extruded flat tubed strip, whereby a cooling medium introduced in said apparatus is completely sealed inside.

23. The winding sealed small tube apparatus of claim 22 wherein each extruded flat tubed strip is constituted by an aluminum alloy extruded material.

24. The winding sealed small tube apparatus of claim 22 wherein each extruded flat tubed strip and said first and second header are brazed with an anti-corrosive flux.

25. The winding small tube apparatus of claim 22 wherein each extruded flat tubed strip is constituted by an aluminum alloy extruded material; and said extruded flat tubed strip and said first and second header are brazed with an anti-corrosive flux.

26. The winding sealed small tube apparatus of claim 22 wherein said extruded flat tubed strip and said first and second header are brazed with an anti-corrosive flux; and said anti-corrosive flux is coated beforehand at least on said extruded flat tubed strip or said first and second header.

27. The winding sealed small tube apparatus of claim 22 wherein each extruded flat tubed strip is constituted by an aluminum alloy extruded material;

said extruded flat tubed strip and said first and second header are brazed with an anti-corrosive flux; and said anti-corrosive flux is coated beforehand at least on said extruded flat tubed strip or said first and second header.

28. A winding sealed small tube apparatus comprising:

an extruded flat tubed strip having a plurality of openings leading to parallel lumens;

a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein linking portions for linking said parallel lumens, so as to form a sealed winding channel, are formed on at least one of said extruded flat tubed strip and said first header; and said second header; one of said openings of said extruded flat tubed strip is made into a means for introducing a cooling medium into said channel; and said means for introducing said cooling medium is sealed for sealing said cooling medium in said channel.

29. The winding sealed small tube apparatus of claim 28, wherein said extruded flat tubed strip is made of an aluminum alloy extruding material.

30. The winding sealed small tube apparatus of claim 28, wherein said extruded flat tubed strip and each of said first and second header are brazed with an anti-corrosive flux.

31. The winding sealed small tube apparatus of claim 29, wherein said extruded flat tubed strip and said first and second header are brazed with an anti-corrosive flux.

32. The winding sealed small tube apparatus of claim 30 or 31, wherein said anti-corrosive flux is coated beforehand on at least said extruded flat tubed strip or said first and second header.

33. A winding sealed small tube apparatus comprising:

an extruded flat tubed strip having a plurality of openings leading to parallel lumens;

a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein every other neighboring end part of partitions at said openings is cut out to form a connecting mouth for connecting said parallel lumens; said header is inserted and connected to a cut-out level that leaves the outer wall of said extruded flat tubed strip intact; said header is placed inside said extruded flat tube; and wherein cooling medium introduced into said apparatus is completely sealed therein.

34. The winding sealed small tube apparatus of claim 33, wherein said extruded flat tubed strip is made of an aluminum alloy extruding material.

35. A winding sealed small tube apparatus comprising:

an extruded flat tubed strip having a plurality of openings leading to parallel lumens; and a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein said end is cut out to form an outer cut-out level that leaves the outer walls of said extruded flat tubed strip uncut, and said end is further cut out to form an inner cut-out level that leaves partitions of said parallel lumens next to said outer walls and said outer walls uncut, and every other one of said partitions between said partitions next to said outer walls are further cut out to form a connecting mouth for connecting said parallel lumens in a winding, serpentine fashion, and said first header, made of an outer body and an inner body, is connected to said end and within said extruded flat tubed strip such that said inner body is inserted and connected to said inner cut-out level and said outer body is inserted and connected to said outer cut-out level, said inner body and said outer body coordinate to form a linking channel that links said parallel lumens at the extreme sides of said extruded flat tubed strip; and wherein a cooling medium introduced into said apparatus is completely sealed therein.

36. The winding sealed small tube apparatus of claim 35, wherein said extruded flat tubed strip is made of an aluminum alloy extruding material.

37. The winding sealed small tube apparatus of claim 33, 34, 35, or 36, wherein said extruded flat tubed strip and said first and second header are brazed with an anti-corrosive flux.

38. The winding sealed small tube apparatus of claim 33, 34, 35, or 36, wherein said extruded flat tubed strip and said first and second header are brazed with an anti-corrosive flux; and said anti-corrosive flux is coated beforehand at least on said extruded flat tubed strip or said first and second header.

39. A manufacturing method of a winding sealed small tube apparatus including an extruded flat tubed strip having a plurality of openings leading to parallel lumens and a first header and a second header for attaching to an end and an opposite end, respectively of said extruded flat tubed strip, comprising the steps of:

providing linking passages near said end and opposite end of said strip to connect said parallel lumens to form a winding channel;

attaching said first header to said end and said second header to the opposite end to close and tightly seal said winding channel;

inserting a cooling medium in said winding channel via a mouth of one of said openings; and closing the mouth of said one of said openings, whereby said cooling medium is completely sealed inside said winding channel.

40. A winding sealed small tube apparatus comprising:

an extruded flat tubed strip having a plurality of openings leading to parallel lumens;

a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein each successive pair of adjoining parallel lumens are connected alternately at said end and said opposite end, and each of said end and said opposite end is covered with said respective first and second header to form a continuous winding sealed channel, whereby a cooling medium introduced in said channel is completely sealed inside.

41. A winding sealed small tube apparatus comprising:

an extruded flat tubed strip having a plurality of openings leading to parallel lumens;

a first header for connecting to an end of said extruded flat tubed strip to cover and tightly seal said end;

a second header for connecting to an opposite end of said extruded flat tubed strip to cover and tightly seal said opposite end, the opposite end being opposite to said end; and wherein linking portions for linking said parallel lumens, so as to form a winding channel, are formed on at least one of:

said extruded flat tubed strip and said first header and said second header; and said first header and said second header tightly seal said end and said opposite end, respectively, such that a cooling medium introduced in said channel is completely sealed inside.

* * * * *

UNITED STATES PATENT AND TRADEMARK OFFICE

CERTIFICATE OF CORRECTION

PATENT NO. : 5,704,415

DATED : January 6, 1998

INVENTOR(S) : Suzuki et al.

It is certified that error appears in the above-identified patent and that said Letters Patent is hereby corrected as shown below:

On the title page item [73],

Assignees: should read Nippon Light Metal Co., Ltd., Tokyo and Masamichi Suzuki, Kanagawa-Ken, both of Japan

Signed and Sealed this

Tenth Day of November 1998

*Attest:*

Bruce Lehman

BRUCE LEHMAN

*Attesting Officer*

*Commissioner of Patents and Trademarks*